US011054780B2

(12) United States Patent
Oya

(10) Patent No.: US 11,054,780 B2
(45) Date of Patent: Jul. 6, 2021

(54) IMAGE FORMING APPARATUS WITH AUTOMATIC CLEANING MODE

(71) Applicant: CANON KABUSHIKI KAISHA, Tokyo (JP)

(72) Inventor: Hiroshi Oya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/558,434

(22) Filed: Sep. 3, 2019

(65) Prior Publication Data

US 2020/0073307 A1 Mar. 5, 2020

(30) Foreign Application Priority Data

Sep. 4, 2018 (JP) ..... JP2018-165051

(51) Int. Cl.
*G03G 15/00* (2006.01)
*G03G 15/20* (2006.01)

(52) U.S. Cl.
CPC ..... *G03G 15/5016* (2013.01); *G03G 15/2025* (2013.01)

(58) Field of Classification Search
None
See application file for complete search history.

(56) References Cited

U.S. PATENT DOCUMENTS

| | | | | |
|---|---|---|---|---|
| 5,865,121 | A | 2/1999 | Testardi et al. | |
| 8,285,183 | B2 | 10/2012 | Nishida et al. | |
| 2008/0170262 | A1* | 7/2008 | Takahashi | H04N 1/00411 358/1.15 |
| 2012/0189360 | A1* | 7/2012 | Shirai | G03G 15/2025 399/327 |

FOREIGN PATENT DOCUMENTS

| | | | |
|---|---|---|---|
| JP | 2003-076198 | A | 3/2003 |
| JP | 2003-182052 | A | 7/2003 |
| JP | 2007-065328 | A | 3/2007 |
| JP | 2010-249971 | A | 11/2010 |
| JP | 2018-132610 | A | 8/2018 |

OTHER PUBLICATIONS

JP_2003182052_A_T MachineTranslation, Japan, Jul. 2003, Hara.*
Office Action dated Jun. 23, 2020, in Japanese Patent Application No. 2018-165051.
Office Action dated Jan. 5, 2021, in Japanese Patent Application No. 2018-165051.

* cited by examiner

*Primary Examiner* — Victor Verbitsky
(74) *Attorney, Agent, or Firm* — Venable LLP

(57) ABSTRACT

An image forming apparatus includes an image forming portion, a rotatable heating member and a rotatable pressing member, a cleaning mode executing portion, an information display portion, a mode setting portion, and a controller capable of outputting, when a predetermined condition is satisfied on the basis of an image formation history in a state in which setting for automatically executing an operation in a cleaning mode is not made, a display prompting execution of the operation in the cleaning mode and a display prompting setting for automatically executing the operation in the cleaning mode.

7 Claims, 17 Drawing Sheets

| DATA ITEM | STORED IN RAM 42 | STORED IN NVMEM 43 | SET VALUE EXAMPLE |
|---|---|---|---|
| OUTPUT IMAGE DATA INFO (801) | ○ | × | • DOT COUNT NUMBER : 1000000<br>• HIGH DENSITY AREA : NO<br>• HALFTONE AREA : YES<br>• PRINT RATIO : 70% |
| CUMULATIVE VALUE OF PRINT PAGE NUMBER INCLUDING HALFTONE AREA (802) | ○ | ○ (ONLY AT POWER OFF, RESTART) | 50 SHEETS |
| RECOMMENDATION CLEANING TIMING INITIAL DETECTION HISTORY(803) | × | ○ | YES |
| OPERATION MODE SETTING (804) | × | ○ | AUTO |
| SHEET FEEDING SETTING (805) | × | ○ | MANUAL : OFF<br>CASSETTE1 : ON<br>CASSETTE2 : OFF<br>CASSETTE3 : OFF<br>CASSETTE4 : OFF |

FIG.8

| DATA ITEM | STORED IN RAM 42 | STORED IN NVMEM 43 | SET VALUE EXAMPLE |
|---|---|---|---|
| OUTPUT IMAGE DATA INFO (1401) | ○ | × | • DOT COUNT NUMBER : 1000000<br>• HIGH DENSITY AREA : NO<br>• HALFTONE AREA : YES<br>• PRINT RATIO : 70% |
| CUMULATIVE VALUE OF PRINT PAGE NUMBER INCLUDING HALFTONE AREA (1402) | ○ | ○ (ONLY AT POWER OF, RESTART) | 50 SHEETS |
| RECOMMENDATION CLEANING TIMING INITIAL DETECTION HISTORY(1403) | × | ○ | YES |
| OPERATION MODE SETTING (1404) | × | ○ | AUTO |
| SHEET FEEDING SETTING (1405) | × | ○ | MANUAL : OFF<br>CASSETTE1 : ON<br>CASSETTE2 : OFF<br>CASSETTE3 : OFF<br>CASSETTE4 : OFF |
| ENV. TEMP. INFO(1406) | ○ | × | 20℃ |
| PRINT INTERVAL(1407) | ○ | × | 30 MIN. |
| CLEANING EXECUTION RECOMMENDATION DATE AND TIME INFO(1408) | × | ○ (ONLY AT POWER OFF, RESTART) | 2018/04/20<br>14:33 |

FIG.14

| AMBIENT TEMP. INFO | ≤15°C | 16-29°C | 30°C≤ |
|---|---|---|---|
| PRINT INTERVAL (MIN.) | 20 MIN. | * LINEARLY CHANGES DEPENDING ON DETECTED TEMP. | 50 MIN. |

* PRINT INTERVAL(MIN.)=(AMBIENT TEMP. INFO -15 )×2+20

IMAGE FORMING APPARATUS WITH AUTOMATIC CLEANING MODE

FIELD OF THE INVENTION AND RELATED ART

The present invention relates to an image forming apparatus such as a copying machine, a printer, a facsimile machine, or a multi-function machine having functions of these machines.

In the image forming apparatus such as a copying machine, a print job or a copy job from an external device such as a PC is received, and a sheet feeding speed of sheets at a printing portion and a toner fixing temperature are adjusted correspondingly to setting of received data and thus printing is executed. When such printing is repetitively performed, a contaminant is deposited on rollers of a fixing device for fixing toner, so that the contaminant is deposited on the sheet subjected to the printing in some cases.

In order to improve a state such that the contaminant is deposited on the print sheet, it is known that execution of cleaning of the fixing device as disclosed in, for example, Japanese Laid-Open Patent Application (JP-A) 2010-249971 is effective. Further, as disclosed in JP-A 2003-76198 and JP-A 2018-132610, techniques such that in the case where a user manually executes the cleaning of the fixing device, an image forming apparatus automatically executes the cleaning of the fixing device every predetermined number of sheets from that time have also been known.

However, in some cases, there is a need to use a sheet (sheets) for cleaning the fixing device. In such a case, the sheet (paper) of the user is used, and therefore, when setting for automatically executing the cleaning of the fixing device is made as default setting, a demand of a user who intends to save the sheets in performance to an image quality cannot be met.

On the other hand, a user who feels a trouble about selecting necessity or unnecessity of the cleaning of the fixing device manually every time above exists. Further, the necessity or unnecessity and proper timing of the cleaning of the fixing device are not readily known by a user, and therefore, the user who desires automatic execution of the cleaning of the fixing device also exists.

SUMMARY OF THE INVENTION

A principal object of the present invention is to provide an image forming apparatus capable of satisfying user's needs.

According to an aspect of the present invention, there is provided an image forming apparatus comprising: an image forming portion configured to form a toner image on a recording material; a rotatable heating member and a rotatable pressing member which are configured to fix the toner image with heat and pressure by nipping and feeding, in a nip, the recording material on which the toner image is formed by the image forming portion; an executing portion configured to execute an operation in a cleaning mode for cleaning a surface of the rotatable heating member by introducing, to the nip, a recording material on which a predetermined toner image is formed by the image forming portion or a recording material on which an image is not formed; a display portion configured to display information; a setting portion capable of switching an operation in a mode for executing the operation in the cleaning mode by manual input, and an operation in a mode for automatically executing the operation in the cleaning mode when a predetermined condition is satisfied on the basis of an image formation history; and a controller capable of outputting, when the predetermined condition is satisfied on the basis of the image formation history in a state in which the setting for automatically executing the operation in the cleaning mode is not made, a display prompting execution of the operation in the cleaning mode and a display prompting setting for automatically executing the operation in the cleaning mode.

Further features of the present invention will become apparent from the following description of exemplary embodiments with reference to the attached drawings.

BRIEF DESCRIPTION OF THE DRAWINGS

FIG. 8 is a table showing characteristic information stored in a RAM or an NVMEM and showing a setting value example in the embodiment 1.

FIG. 14 is a table showing characteristic information stored in a RAM and an NVMEM and showing a setting value example in the embodiment 2.

DESCRIPTION OF EMBODIMENTS

Embodiment 1

(Image Forming Portion)

Figure 2:
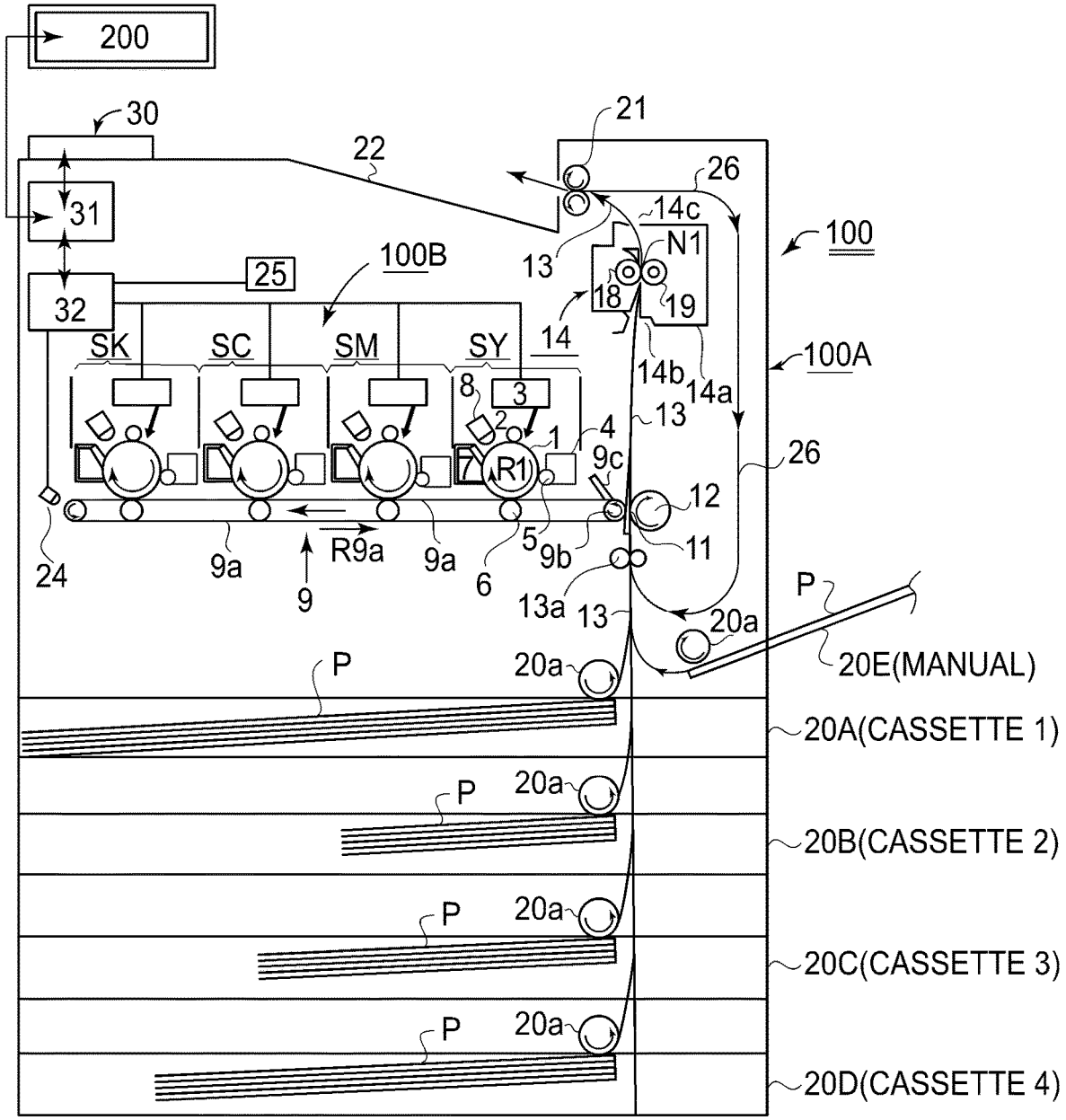
FIG. 2 is a schematic sectional view of an example of an image forming apparatus in the embodiment 1.

FIG. 2 is a schematic structural view of an image forming apparatus 100 in this embodiment, which is a four-color based full-color printer which uses an electrophotographic process and which is of a tandem type and an intermediary transfer type. This image forming apparatus 100 executes a print operation (image forming operation: printing operation) corresponding to a print job (image forming job, printing job) inputted from an external device (host device) 200 to a controller unit 31. As a result, a recording material on which a toner image is formed is outputted (printed out).

The recording material (sheet, cut-sheet paper) as a recording medium (media) on which the toner image is capable of being formed by the image forming apparatus 100 includes, for example, plain paper, thick paper, envelope, postcard, seal, resin sheet, overhead projector sheet (OHT sheet) and the like. In the following description, the recording material is referred to as a sheet or paper. Further, description will be made using terms relating to paper, such as sheet (paper) passing, sheet (paper) feeding, sheet (paper) discharge, and the like, but a material of the recording material is not limited to the paper.

The controller unit 31 and a printer controller 32 control and monitor printer constituted devices (various devices) and unify instruction systems among the respective devices, and thus collect and organize predetermined device operations of an entirety of the image forming apparatus 100. That is, the controller unit 31 and the printer controller 32 are control devices of the image forming apparatus 100.

The heat device 200 is a personal computer (PC), an image reader, a facsimile machine, a network, and the like. The print job refers to an image formation instruction to which print condition information such as image data, and a kind, a basis weight, a size, the number of sheets, the number of copies, a layout, a post-process and the like of a designated sheet are added.

The image forming apparatus 100 includes an operating portion 30 (user interface: operating panel for permitting communication with a user and the external host device 200 and access to the devices) for permitting input of various pieces of information to the controller unit 31. Hereinafter, this operating portion 30 is referred to as a UI portion 30. The UI portion 30 holds keys for operating the devices and LEDs for displaying states of the devices, and is capable of inputting various settings when image formation is carried out. Further, the UI portion 30 also has a display function of displaying messages for notifying the user of a state of the image forming apparatus 100 and displaying information inputted by the user.

Figure 4:
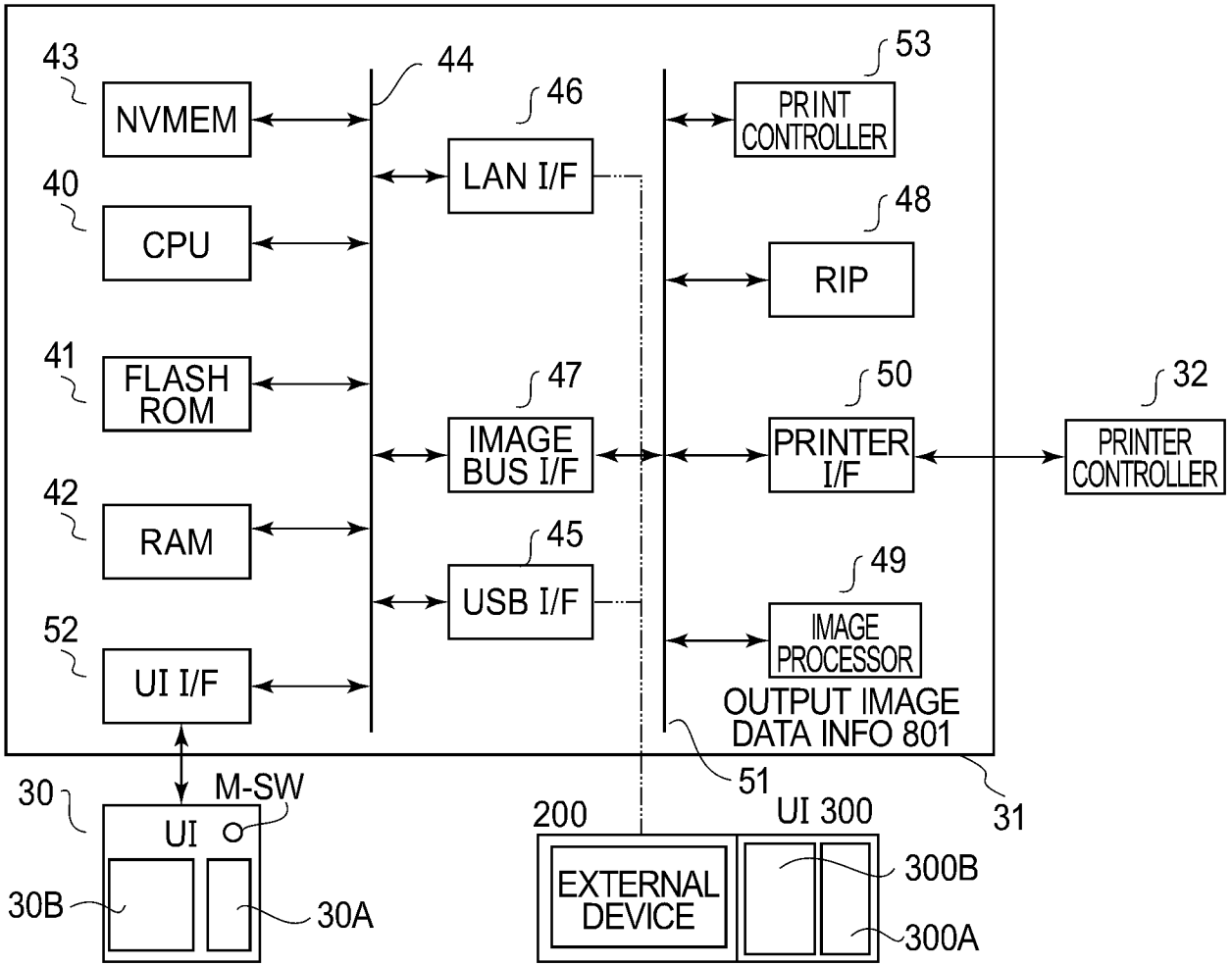
FIG. 4 is a block diagram showing a hardware constitution of a controller unit of the image forming apparatus in the embodiment 1.

That is, the UI portion 30 includes an operation input portion 30A and a display portion 30B (display means: monitor) as shown in FIG. 4. The UI portion 30 is also provided with a main power switch M-SW of the image forming apparatus 100. The operation input portion 30A is provided with selection buttons (keys) and the like of operations in various control modes. The display portion 30B is a touch panel (LCD) capable of information display and operation in general. On the touch panel, in addition to various pieces of information, buttons capable of being operated on a screen are displayed and are capable of being pressed, so that device functions and operations corresponding to the pressed buttons are executed by the controller unit 31 and the printer controller 32.

An image forming apparatus main assembly (apparatus frame, hereinafter referred to as an apparatus main assembly) 100A includes an image forming portion (toner image forming portion for forming toner images on sheets) 100B provided with first to fourth image forming stations S (Y, M, C, K). Further, the image forming portion 100B is provided with an intermediary transfer unit 9 under the first to fourth image forming stations S (Y, M, C, K).

Further, below the image forming portion 100B, upper and lower multi-stage cassette sheet (paper) feeding portions 20A-20D are provided. In this embodiment, upper and lower four-stage cassette sheet feeding portions are provided. In the following, from above to below, these portions are referred to as cassettes 1, 2, 3 and 4, respectively. Further, on a right-hand side of the image forming apparatus 100, a manual sheet feeding tray 20E is provided.

The first to fourth image forming stations S (Y, M, C, K) form toner images of four colors of yellow (Y), magenta (M) and cyan (C) which are three primary colors of subtractive color mixture, and black (K), respectively. Each of the image forming stations S (Y, M, C, K) includes a rotatable drum-type electrophotographic photosensitive member (hereinafter referred to as a photosensitive drum) 1 as an image bearing member, and electrophotographic process devices 2 to 8 which are provided successively around the photosensitive drum 1 along a drum rotational direction R1 and which are actable on the photosensitive drum 1. The process devices 2 to 8 include a charger 2, a laser scanner 3, a developing device 4 provided with a developing roller 5, a primary transfer roller 6, a drum cleaner 7 and a pre-exposure device 8.

Incidentally, in order to avoid complicatedness, reference numerals or symbols of these devices in the second to fourth image forming stations SM, SC and SK other than the first image forming station SY were omitted. Further, an electrophotographic image forming operation of the image forming portion 100B provided with the first to fourth image forming stations S (Y, M, C, K) and the intermediary transfer unit 9 is well known and therefore will be omitted from description.

The toner images of the respective colors are successively primary-transferred in a predetermined superposition manner from the photosensitive drums 1 to the first to fourth image forming stations S (Y, M, C, K) onto an intermediary transfer belt (hereinafter referred to as ITB) 9*a* as an intermediary transfer member rotatable in an arrow direction R91. As a result, on the ITB 9*a*, unfixed and superposed toner images of the four colors of Y, M, C and K are formed.

On a right-hand side of an inside of the apparatus main assembly 100A, an upward feeding path 13 for feeding a sheet P from below to above is provided. At predetermined control timing, a sheet feeding roller 20*a* of a selected and designated stage cassette of the upper and lower multi-stage cassettes 1 to 4 in which sheets different in size and material are stacked and accommodated is driven. Or, in the case where the manual feeding tray 20E is selected and designated, a feeding roller 20*a* thereof is driven. As a result, the sheet P of the selected and designated stage cassette or the manual feeding tray 20E is separated one by one and fed and thus is introduced into the feeding path 13, so that the sheet P is inserted into a secondary transfer portion 11 at predetermined control timing by a registration roller pair 13*a*.

The secondary transfer portion 11 is a nip, between the ITB 9*a* and the secondary transfer roller 12, formed by bringing a secondary transfer roller 12 into contact with the ITB 9*a* toward a belt extending roller 8*b* provided on a right-hand side of the intermediary transfer unit 9, and the sheet P is nipped and fed through the secondary transfer portion 11. As a result, at the secondary transfer portion 11, the four-color superposed toner images are successively and collectively secondary-transferred from the ITB 9*a* onto the surface of the sheet P.

The sheet P coming out of the secondary transfer portion 11 is separated from the surface of the ITB 9*a* and is introduced into a fixing device (image heating apparatus) 14 by being fed further upward along the feeding path 13, so that the toner images are fixed on the sheet P by the fixing device 14. Secondary transfer residual toner on the ITB 9*a* is removed from ITB 9*a* by a belt cleaner 9*c*.

The fixing device 14 fixes, as a fixed image, the unfixed toner image formed on the sheet P in a fixing nip N1 formed by cooperation of a fixing roller 18 as a rotatable heating member and a pressing roller 19 as a rotatable pressing member. The sheet P coming out of the fixing device 14 passes toner the feeding path 13 and is discharged, as a one-side print, by a discharging roller pair 21 onto a discharge tray 22 provided at an upper portion of the apparatus main assembly 100A in the case of a one-side print mode.

In the case where double-side print mode is selected, the sheet which comes out of the fixing device 14 and which has already been subjected to one-side printing is sent toward the discharge tray 22 by the discharging roller pair 21, and rotation of the discharging roller pair 22 is reversed at the time immediately before a trailing end portion of the sheet P passes through the discharging roller pair 21. As a result, the sheet P which has already been subjected to printing on a first (front) surface thereof is fed in a switch-back manner and is introduced into a feeding path 26 for double-side feeding. Then, the sheet P in a state in which the sheet P is turned upside down is fed to the registration roller pair 13 and then is fed by the registration roller pair 13. Thereafter, similarly as in the case of the one-side printing, the sheet P is fed to the secondary transfer portion 11 and the fixing device 14 along the feeding path 13 and then is discharged as a double-side print, onto the discharge tray 22 by the discharging roller pair 21.

In the case of a monochromatic (single color) printing mode, of the first to fourth image forming stations S (Y, M, C, K), only the image forming station necessary to form the image of a designated color performs an image forming operation, and other image forming stations are only idled and do not perform the image forming operation.

Incidentally, a density detecting sensor 24 for the toner image formed on the ITB 9*a* is used for density control of an output image. Further, an ambient temperature and humidity sensor 25 is used for control of operations of the image forming apparatus 100 and the fixing device 14.

(Fixing Device)

Figure 3:
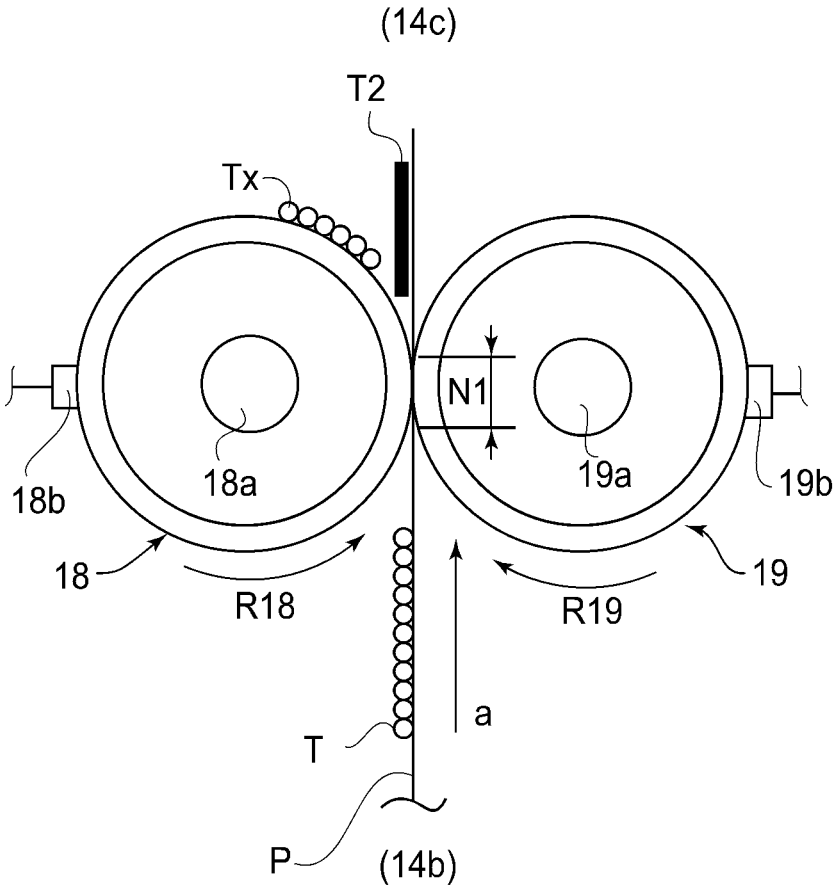
FIG. 3 is a schematic sectional view of a principal pat of the fixing device in the embodiment 1.

FIG. 3 is a schematic cross-sectional view of a principal part of the fixing device 14. This fixing device 14 is a fixing device of a heating roller type and employs an inner heating constitution, and includes the rotatable heating member and the rotatable pressing member which are used for fixing, in the nip, the toner image formed on the sheet P. Incidentally, the fixing device is not limited to the fixing device 14, but can also use fixing devices of various types such as a belt (film) heating type which is an ODF constitution, an electromagnetic heating type and an externally heating type.

With reference to FIGS. 2 and 3, the fixing device 14 roughly includes, 1) the fixing roller 18 as the rotatable heating member (fixing member) for heating the toner image on the sheet P (recording material) in contact with the toner image,
2) the pressing roller 19 as the rotatable region member (back-up member) for forming the fixing nip (heating nip) N1 in which the sheet P is nipped and fed in cooperation with the fixing roller 18, and
3) a casing (device frame) 14*a* accommodating these rollers.

The fixing roller 18 is constituted by a hollow core metal of Al, an Si rubber layer formed as an intermediary layer on the core metal, and a fluorine-containing layer formed as a surface layer on the rubber layer. Inside the fixing roller 18 (inside the hollow core metal), a heater (halogen heater) 18*a* is incorporated, so that the fixing roller 18 is heated (internally heated) from the inside thereof by this heater 18*a*.

The pressing roller 19 is constituted by a hollow core metal of Al, an Si rubber layer formed as an intermediary layer on the core metal, and a fluorine-containing layer formed as a surface layer on the rubber layer. Inside the pressing roller 19 (inside the hollow core metal), a heater (halogen heater) 19*a* is incorporated, so that the pressing roller 19 is heated from the inside thereof by this heater 19*a*.

The fixing roller 18 and the pressing roller 19 are rotatably provided inside the casing 14*a* substantially in parallel to each other, and are press-contacted to each other at a predetermined pressing force (pressure) by pressing mechanisms (not shown), so that the fixing nip N1 having a predetermined width with respect to a sheet feeding direction a is formed between the fixing roller 18 and the pressing roller 19. The fixing roller 18 and the pressing roller 19 are rotationally driven in directions of arrows R18 and R19, respectively, by driving mechanisms (not shown) so as to nip and feed the sheet P through the nip N1 at a predetermined speed in a predetermined direction.

Temperature detecting elements 18*b* and 19*b* for detecting surface temperatures of the fixing roller 18 and the pressing roller 19, respectively, are provided, and on the basis of detection temperature information inputted from these temperature detecting elements 18*b* and 19*b*, the printer controller 32 controls electric power supplied to the heaters 18*a* and 19*a*. That is, the printer controller 32 controls the electric power supplied from an energization portion (not shown) to the heaters 18*a* and 19*a* so that the surface temperatures of the fixing roller 18 and the pressing roller 19 are increased and maintained at predetermined temperatures, respectively. For example, during image formation, the fixing roller 18 and the pressing roller 19 are temperature-controlled so that the surface temperatures thereof are maintained at 160° C. and 100° C., respectively.

The casing 14*a* is provided with a sheet inlet 14*b* and a sheet outlet 14*c*. The fixing roller 18 and the pressing roller 19 are disposed so that the sheet inlet 14*b* is positioned below the sheet outlet 14*c* with respect to the direction of gravitation. The fixing device 14 in this embodiment is constituted so as to feed the sheet P from below toward above with respect to the direction of gravitation, and this constitution is referred to as a vertical path constitution.

The sheet P on which the unfixed toner images T are carried is induced into the fixing device 14 through the sheet inlet 14*b* of the casing 14*a* and is inserted into the fixing nip N1, and thus is nipped and fed. An unfixed toner image carrying surface of the sheet P opposes the fixing roller 18. Then, the unfixed toner images T are fixed as fixed images on the sheet P by heat of the fixing roller 18 and nip pressure in the fixing nip N1.

That is, heat of the surface of the fixing roller 18 is conducted to the unfixed toner images and the sheet P, so that the toner images T are fixed on the surface of the sheet P. T2 represents the fixed toner images passed through the fixing nip N1. Tx represents contaminant toner gradually accumulated on the surface of the fixing roller 18. This contaminant toner Tx will be described later.

(Controller User)

FIG. 4 is a block diagram showing a hardware constitution of the controller unit 31 constituting the control device of the image forming apparatus 100. The controller unit 31 performs input and output of image data and device information by being connected to the printer controller 32 which is a control processor of the image forming apparatus 100 (hereinafter also referred to as a printer).

A CPU 40 is a processor for controlling an entirety of a system. A flash ROM 41 is a non-volatile memory, and various control programs for controlling the system are stored. A RAM 42 is a system work memory for operating the CPU 40 and is also a program memory for storing the programs and an image memory for temporarily storing the image data. An NVMEM 43 is a non-volatile memory and stores setting information and the like. However, the NVMEM 43 may also be another storing device such as HDD.

The UI portion 30 includes an operation input portion 30A, and the operation input portion 30A holds keys for operating the devices and LEDs for displaying states of the devices. A UI I/F 52 is an interface portion with the UI portion 30 and sends LED control information held by the UI portion 30. Further, the UI I/F 52 also has the function of transmitting input, inputted from the UI portion 30 by the user, to the CPU 40. Further, the UI portion 30 includes a display portion 30 such as an LCD, and displays message by which a state of the image forming apparatus 100 is notified to the user and displays information inputted by the user.

A USB I/F 45 enables USB connection with the external device 200. A LAN I/F 46 enables LAN connection with the external device 200.

The above-described devices are disposed on a system bus 44.

An image bus I/F 47 is a bus bridge for connecting the system bus 44 and an image bus 51 for transferring image data at high speeds between itself and the system bus 44 and for converting data structure. The image bus 51 is constituted by a DCI bus or an IEEE 1394. On the image bus 51, the following devices are provided. A raster image processor (RIP) 48 develops vector data, such as PDL codes, into bit map images.

The printer I/F 50 connects the printer controller 32 and the controller unit 31 and performs conversion of synchronism system/non-synchronism system of the image data, sending and receiving of control commands, and electric power supply. The image processing portion 49 performs correction, processing and complication of the image data and performs correction of the printer, resolution conversion and the like with respect to the print output image data. Further, in addition thereto, the image processing portion performs rotation of the image data and performs compression and expansion processing such as JPEG for multi-level image data and JBIG, MMR, MH and the like for two-level image data.

Further, output image data information 801 obtained as a result of the image processing is associated with each of print pages and is stored (held) in the RAM 42 or the NVMEM 43. In this embodiment, description will be made such that the output image data information 801 is stored in the RAM 42. The output image data information 801 includes at least count information of dots printed with output image data, presence or absence of a high density region (area), presence or absence of a halftone (area), a print ratio of an entirety of an output image, and the like, for example.

Here, in this embodiment, characteristic information and setting value examples which are stored in the RAM 42 or the NVMEM 43 are shown in FIG. 8. Description of respective items shown in FIG. 8 will be specifically described later in combination with processes relating to the respective items.

A print controller 53 analyzes input image data and print setting of the input image data. Further, the print controller 53 compared setting information, which is notified from the printer controller 32 and which is stored in the NVMEM 43, with the input image data and the print setting of the input image data. As a result of comparison, in the case where the setting information is not appropriate for executing the printing, execution of the printing is stopped, the print controller 53 notifies the CPU 40 of information so as to cause the display portion 30B of the UI portion 30 to display an error.

For example, it is assumed that the cassette 1 is designated in the print setting of the input image data and that plain paper is designated as a sheet type (kind). In this embodiment, when sheet type setting of the cassette 1 stored in the NVMEM 43 is not the plain paper, the print controller 43 notifies the CPU 40 of an error to the effect that replacement of the sheet is needed.

Further, the image processing portion 49 acquires the output image data information 801 stored in the RAM 42 and sends the output image data information 801 to the printer controller 32 via the printer I/F 50. The printer controller 32 may also change temperature control during the fixing on the basis of the received output image data information 801.

Further, the image processing portion 49 receives, from the printer controller 32, information as to whether or not printing of what page is completed and manages a status of progress of the printing. The printing controller 32 is also a portion for converting the raster image data into the image on the sheet P. As a type thereof, an electrophotographic type using the photosensitive drum or a photosensitive belt, an ink jet type in which ink is ejected from a minute nozzle array and thus an image is directly printed on the sheet, and the like type exist, but either type may be used. A printing operation is started by an instruction from the CPU 40.

(Cleaning of Fixing Device)

In the fixing device 14, the surface of the fixing roller 18 as the rotatable heating member for heat-fixing the toner image on the sheet P by heating and melting the toner in contact with the unfixed toner image carrying surface of the sheet P is gradually contaminated with the toner as the printing progresses, so that the toner Tx is gradually accumulated. When an accumulation amount of toner contamination increases, an image defect is caused to occur by transfer of the toner contamination the sheet, and the like.

Therefore, an operation in a cleaning mode in which the toner contaminant Tx is removed from the surface of the fixing roller 18, i.e., the fixing roller 18 is cleaned, at appropriate timing before the image defect is caused to occur is automatically executed. Further, as desired, the operation in the cleaning mode is made executable at an appropriate time by user's selection. This operation in the cleaning mode for cleaning the fixing roller 18 is hereinafter referred to as fixing device cleaning for convenience.

In the present invention, the fixing device cleaning is of a type in which a sheet is introduced as a cleaning sheet into the fixing nip N1 and then the toner contaminant Tx is transferred from the surface of the fixing roller 18 onto the cleaning sheet. This cleaning type has already been known as various types, and an appropriate cleaning type can be selected.

For example, as disclosed in JP-A 2003-76198 and JP-A 2018-132610, a type in which a cleaning sheet on which an unfixed toner image with a predetermined pattern for cleaning is formed by an image forming portion is introduced into a fixing nip can be used. Further, a type in which a white (blank) sheet on which a toner image with a predetermined pattern for cleaning is not formed is introduced as a cleaning sheet into the fixing nip can be used.

Further, the case where the cleaning sheet is passed through the path for the one-side printing similarly as in the one-side printing and the case where the cleaning sheet is passed through the path for the double-side printing similarly as in the double-side printing exist. Further, the case where a feeding speed of the sheet as the cleaning sheet is unchanged from a feeding speed during normal printing when the fixing device cleaning is executed and the case where control is carried out so as to gradually feed the cleaning sheet by decreasing the feeding speed exist.

In the present invention, the type in which the sheet as the cleaning sheet is introduced into the fixing nip and then fixing device cleaning is carried out is applicable even in any operation specification, and the present invention is not limited to the cleaning operation specification.

Figure 1:
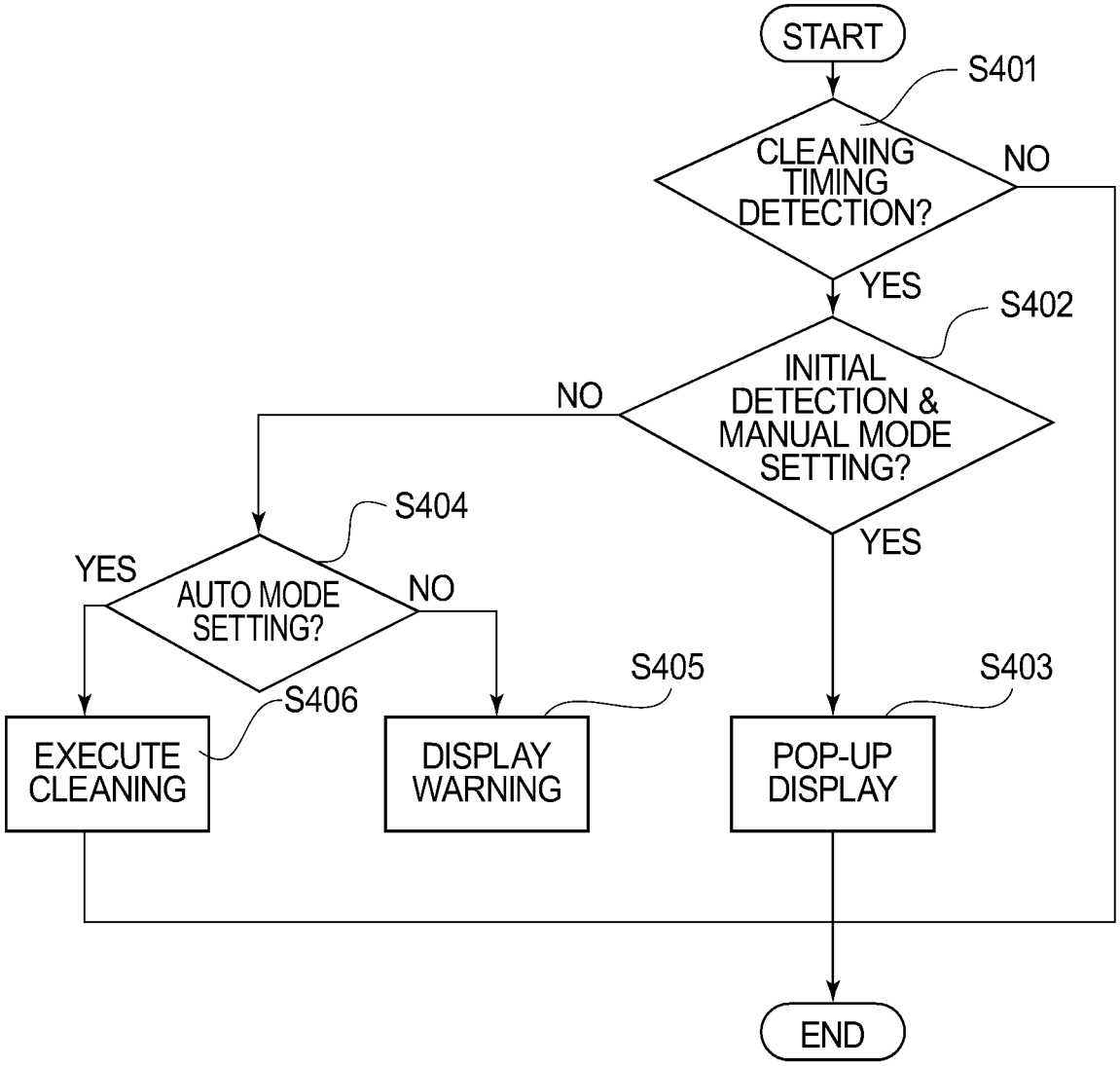
FIG. 1 is a flowchart showing necessity or unnecessity of execution of cleaning of a fixing device and a discriminating process of a UI screen displayed for a user in an embodiment 1 of the present invention.

The above-described operation in the cleaning mode of the fixing device is executed automatically executed timely in accordance with a predetermined control sequence at predetermined control timing by the print controller 53 (executing means) of the controller unit 31. FIG. 1 is a flowchart showing necessity or unnecessity of execution of the fixing device cleaning and a discriminating process of an UI displayed for the user in this embodiment.

The print controller 53 (first discriminating means) discriminates whether or not timing is timing when the fixing device cleaning should be executed (hereinafter referred to as recommended cleaning execution timing, i.e., timing when the fixing device is contaminated with the toner (S401: first discriminating means).

It would be considered that this recommended cleaning execution timing is, for example, the case where the one-side printing is carried out on a predetermined number of sheets, the case where a page on which image data in a predetermined density range exists is printed on a predetermined number of sheets or more, and the case where a cumulative value of the number of counts of printed dots. The recommended cleaning execution timing varies depending on characteristics of the image forming apparatus 100 and the fixing device 14, and therefore, may also be other conditions.

In this embodiment, the case where a cumulative value of the number of print pages including a halftone region (for example, including a certain area or more of image data between 30% and 60% in density) is the recommended cleaning execution timing.

Specifically, the output member data information 801 generated by the image processing portion 49 is acquired by the print controller 53 (cleaning operation control means), and a cumulative value 802 of the print page number including the halftone region (area) (FIG. 8) is counted. In the case where the cumulative value 802 of the print page number including the halftone region is the predetermined number of sheets or more, in S401, detection of the recommended cleaning execution timing is discriminated as "YES". Here, the means for counting the cumulative value 802 of the print page number including the halftone region may also be the printer controller 32. In that case, when the cumulative value 802 of the print page number including the halftone region reaches the predetermined number of sheets or more, the printer controller 32 notifies the print controller 53 of that effect.

In S401, in the case where discrimination of "NO" is made, no action is taken until the cumulative value 802 of the print page number including the halftone region reaches the predetermined number of sheets or more, and the sequence is ended. Further, here, the cumulative value 802 of the print page number including the halftone region is stored in the RAM 42, but may also be stored in the NVMEM 43 during OFF of the main switch of the image forming apparatus 100 or during restart of the image forming apparatus 100. As a result, the cumulative value is stored even when the main switch is turned off or when the restart of the image forming apparatus 100 is carried out, so that discrimination of the recommended cleaning execution timing can be made at appropriate timing.

In S401, in the case where discrimination of "YES" is made, the print controller 53 checks whether the timing is first detected as the recommended cleaning execution timing or automatic execution setting of the fixing device cleaning (hereinafter referred to as operation mode setting) is "manual" (S402). In S402, in the case recommended cleaning execution timing initial detection history 803 (FIG. 8) is "NO" and operation mode setting (cleaning mode operation setting) 804 is "MANUAL", the print controller 53 cause the sequence to go to S403.

Here, when the recommended cleaning execution timing initial detection history 803 is "NO", it shows that the recommended cleaning execution timing is first detected, the print controller 53 sets the recommended cleaning execution timing initial detection history 803 at "YES". In S402, in the case where the recommended cleaning execution timing initial detection history 803 is "YES" or the operation mode setting 804 is "AUTOMATIC", the sequence goes to S404 (cleaning operation control means).

In S402, in the case where detection of "YES" is made, the print controller 53 notifies the CPU 40 that a pop-up screen prompting recommendation of execution of fixing device cleaning and a change of the operation mode setting 804 to "AUTOMATIC" should be displayed. The CPU 40 receiving the notification provides the UI portion 30 via the UI portion I/F 52, with an instruction to display the pop-up screen, so that the UI portion 30 causes the display portion 32B to display the pop-up screen (S403: display means).

In S402, in the case where discrimination of "NO" is made, whether or not the operation made setting 804 is "AUTOMATIC" (S404). In S404, in the case where the operation made setting 804 is "MANUAL", the print controller 53 notifies the CPU 40 of that warning recommending the execution of the fixing device cleaning should be displayed. The CPU 40 receiving the notification provides the UI portion 30 via the UI portion I/F 52, with an instruction to display a pop-up screen, so that the UI portion 30 causes the display portion 32B to display the PUS (S405). By this warning display, manual execution of the fixing device cleaning is prompted to the user and the recommended cleaning execution timing of the fixing device is notified to the user.

In S404, in the case where the operation made setting 804 is "AUTOMATIC", the fixing device cleaning is automatically executed (S406: cleaning operation control means).

Further, here, in the case where the fixing device cleaning during execution fails due to an error such as an occurrence of paper jam, it is desirable that the fixing device cleaning is automatically resumed after correcting the error. Or, a constitution in which a screen showing that the automatic execution of the fixing device cleaning failed and the user is prompted to automatically execute the fixing device cleaning may also be employed.

Figure 6A:
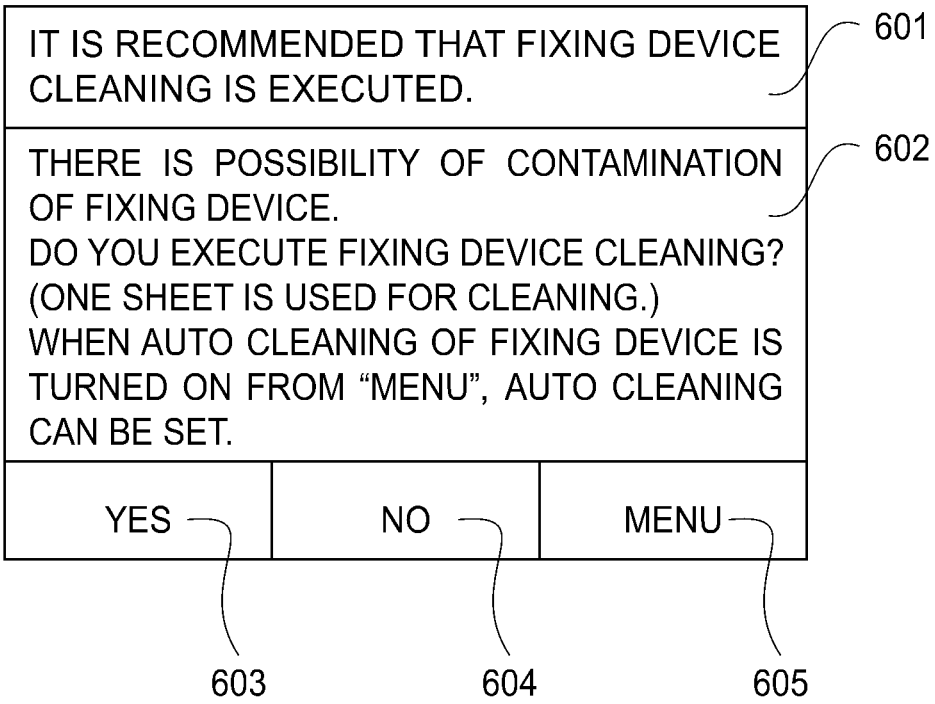
FIG. 6A is a schematic view showing an example of a pop-up screen for displaying the necessity of cleaning of the fixing device and for making the display prompting automatic setting of the cleaning operation mode in the embodiment 1.
Figure 6B:
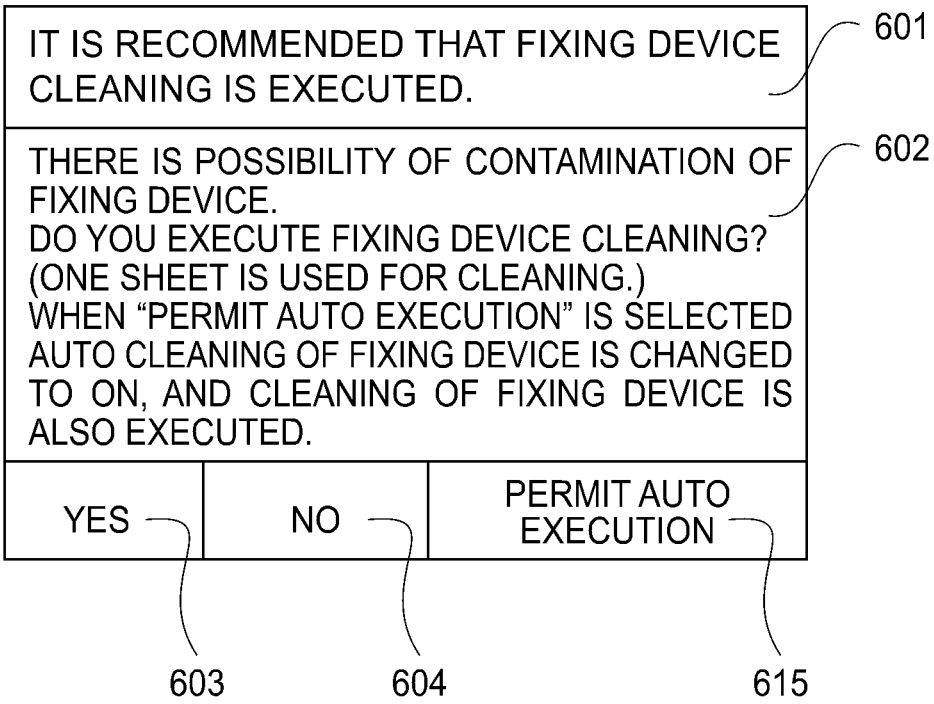
FIG. 6B is a schematic view showing another example of the pop-up screen in the embodiment 1.
Figure 6C:
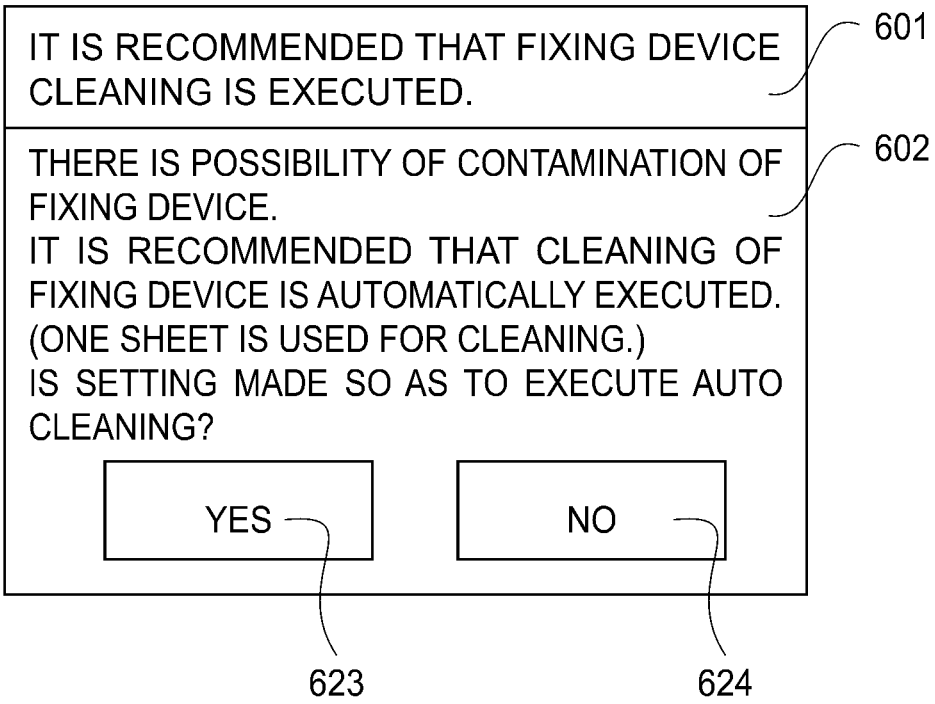
FIG. 6C is a schematic view showing a further example of the pop-up screen in the embodiment 1.

Next, screen examples (display contents) of pop-up screens displayed at the display portion 30B of the UI portion 30 in S403 are shown in FIG. 6A to FIG. 6C. Incidentally, FIG. 6A to FIG. 6C show UI screen examples of a touch panel type, but a UI which is not of the touch panel is also applicable by causing the UI to display and select similar display contents.

In the pop-up screen of FIG. 6A, a screen title region 601 shows a summary of contents of the pop-up screen. A message display region 601 shows details of the contents which are intended to be notified to the user. A button 603 is used for inputting user's intention of "execution" of the fixing device cleaning (cleaning operation setting means). A button 604 is used for inputting user's intention of "non-execution" of the fixing device cleaning (cleaning operation setting means). A button 605 is used for displaying a menu for changing the operation mode setting 804.

FIG. 6B is the screen example characterized by a button 615 (cleaning operation setting means) for inputting user's intention such that the operation mode setting 804 (FIG. 8) is "changed to AUTOMATIC". The contents displayed in the message display region 602 is also changed correspondingly. The buttons 601 to 604 are similar to those in FIG. 6A.

FIG. 6C is the screen example of the UI screen pushing, to the front, that the operation mode setting 804 is changed to "AUTOMATIC" than the execution of the fixing device cleaning. For that reason, the screen title region 601 and the message display region 602 show messages corresponding thereto. A button 623 is used for inputting user's intention that "operation mode setting 804 is changed to AUTOMATIC" (cleaning operation setting means), and a button 624 is used for inputting user's intention that "operation mode setting 804 is not changed to AUTOMATIC" (cleaning operation setting means).

Various screens are applicable when the contents thereof prompt that the operation mode setting 804 is changed to "AUTOMATIC" as described above.

Figure 5:
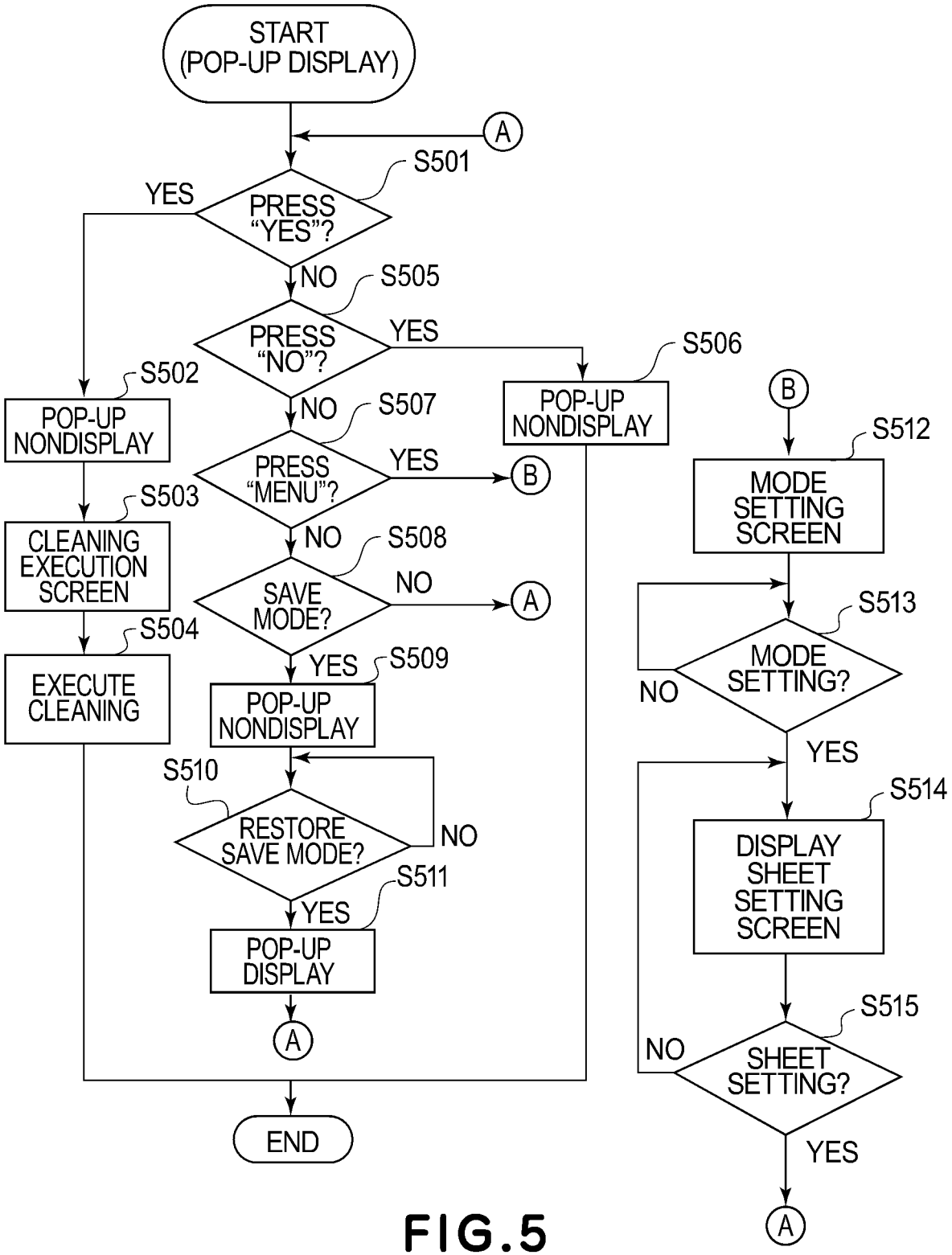
FIG. 5 is a flowchart showing an example of screen transition of a pop-up screen for displaying necessity of the cleaning of the fixing device and for making a display prompting automatic setting of a cleaning operation mode in the embodiment 1.

In this embodiment, assuming that the screen of FIG. 6A is displayed, with reference to FIG. 5, a screen transfer example of the pop-up screen will be described. FIG. 5 starts from display of the pop-up screen.

The UI portion 30 monitors whether or not the button 603 is pressed down in the pop-up screen (S501). When the UI portion 30 detects that the button 603 is pressed down, the UI portion 30 notifies the CPU 40 via the UI I/F 52 of that effect. The CPU 40 receiving the notification provides the UI portion 30 via the UI portion I/F 52 with an instruction that the pop-up screen is not displayed and that a fixing device cleaning execution screen is displayed, so that the UI portion 30 causes the display portion to display a message to that effect (S502, S503).

Figure 9:
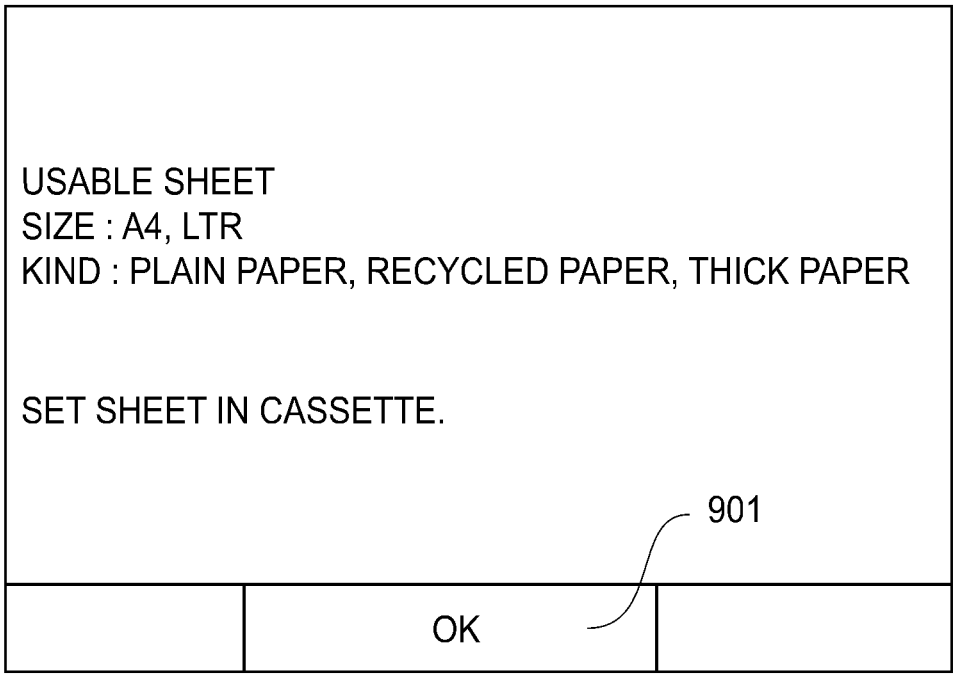
FIG. 9 is a schematic view showing an example of a screen of execution of the cleaning of the fixing device in the embodiment 1.

An example of the fixing device cleaning execution is shown in FIG. 9. FIG. 9 shows the example in which a size and a kind of the sheet P capable of the fixing device cleaning are displayed and in which the user is prompted to set the sheet P. When the user selects a button 901, setting of the sheet P is regarded as being completed, and the fixing device cleaning is started (S504). The screen of FIG. 9 may also be displayed in the case where the fixing device cleaning is executed from a menu button 703 of FIG. 7 described later when the fixing device cleaning is manually executed.

In S501, in the case where the button 603 of FIG. 6A is not pressed down, the UI portion 30 monitors whether or not the button 604 is pressed down (S505). When the UI portion 30 detects that the button 604 is pressed down, the UI portion 30 notifies the CPU 40 via the UI portion I/F 52 of that effect. The CPU 40 receiving the notification provides the UI portion 30 via the UI portion I/F 52 with an instruction that the pop-up screen is not displayed, so that the UI portion 30 causes the display portion so as not to display the pop-up screen (S506). The button 604 is used for inputting user's intention of "non-execution" of the fixing device cleaning, and therefore, the pop-up screen is not displayed and the sequence (process) is ended with doing nothing.

In S505, in the case where the button 604 is not pressed down, the UI portion 30 monitors whether or not the button 605 is pressed down (S507). When the UI portion 30 detects that the button 605 is pressed down, the UI portion 30 notifies the CPU 40 via the UI portion I/F 52 of that effect. The CPU 40 receiving the notification provides the UI portion 30 via the UI portion I/F 52 with an instruction to display a setting screen of the operation mode setting 804, so that the UI portion 30 causes the display portion 30B to display the setting screen (S512: cleaning operation setting means).

Figure 10:
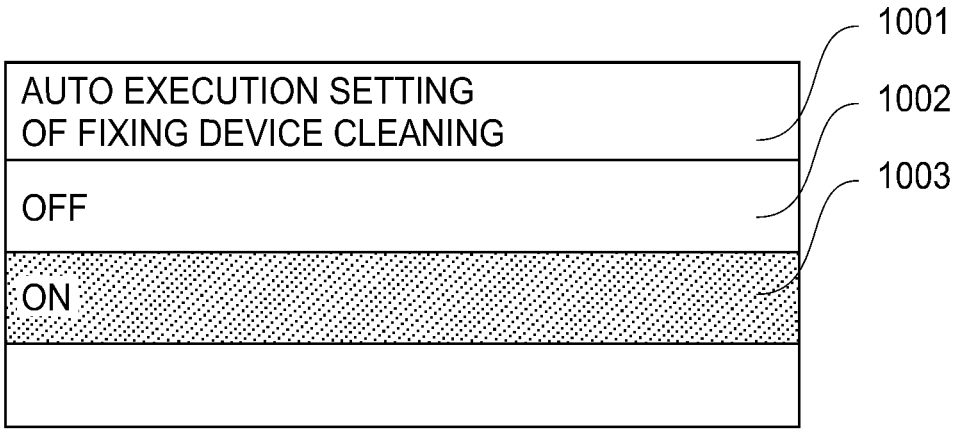
FIG. 10 is a schematic view showing a setting screen example of the cleaning operation mode in the embodiment 1.

A setting screen example of the operation mode setting 804 is shown in FIG. 10. The setting screen includes a screen title region 1001 and setting value selection buttons 1002 and 1003 (cleaning operation setting means). When the button 1002 is selected, the operation mode setting 804 is setting of "MANUAL", and when the button 1003 is selected, the operation mode setting 804 is setting of "AUTOMATIC". The UI portion 30 monitors whether or not the button 1002 or 1003 is pressed down, and when the UI portion 30 detects that the button 1002 or 1003 is pressed down, a set value of the selected button is stored in the NVMEM 42 (S513).

Figure 11:
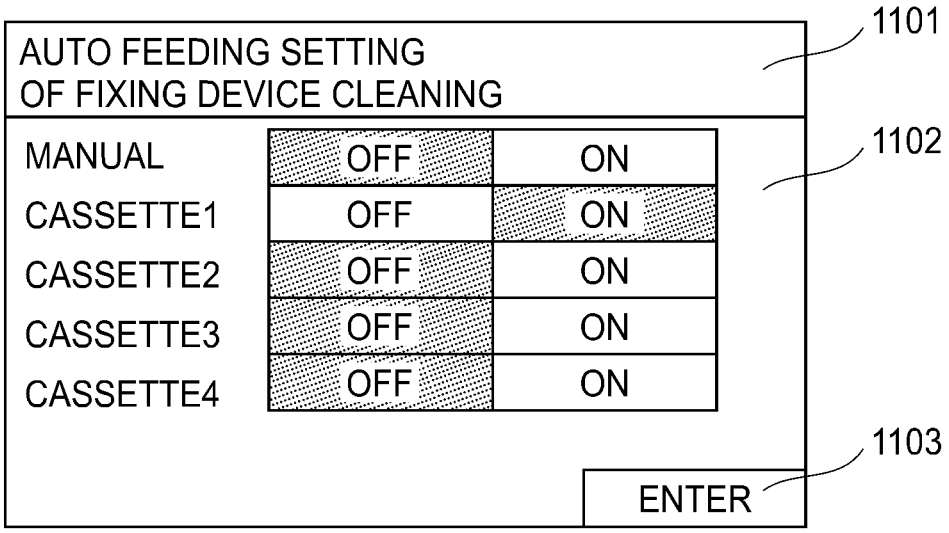
FIG. 11 is a schematic view showing a setting screen example of a sheet feeding stage in the embodiment 1.

Then, the CPU 40 provides the UI portion 30 via the UI portion I/F 52 with an instruction to display a screen of setting of a sheet feeding stage capable of feeding sheets during execution of the fixing device cleaning (hereinafter this setting is referred to as sheet feeding stage setting 805 (FIG. 8)), so that the UI portion 30 causes the display portion 30B to display the screen of the sheet feeding stage setting 805 (S514). A setting screen example of the sheet feeding stage setting 805 is shown in FIG. 11.

The setting screen includes a screen title region 1101 and setting value selection buttons 1102. In the case of the example of FIG. 11, "OFF" and "ON" are settable for five sheet setting stages consisting of cassettes 1 to 4 and a manual feeding tray 20E. Here, the print controller 53 carries out control so that the sheet is fed from only the sheet feeding stage for which "ON" is selected and then the fixing device cleaning is performed. The print controller 53 carries out control so that sheet P is not fed from the sheet feeding stage for which "OFF" is selected even when the sheet P capable of the fixing device cleaning is set in the sheet feeding stage.

For example, by setting for the sheet stage, at "OFF", in which the sheets which are not intended to be used for the fixing device cleaning, setting can be made so that the sheets in the sheet feeding stage are not used for the fixing device cleaning. The UI portion 30 monitors whether or not a button 1103 is pressed down, and when the UI portion 30 detects that the button 1103 is pressed down, the UI portion 30 causes the NVMEM 43 to store setting values for the respective sheet feeding stages as the sheet feeding stage setting 805 (S515).

Here, in this embodiment, the setting of the sheet feeding stage setting 805 made in S515 is effective for both manual execution and automatic execution of the fixing device cleaning, but for example, may also be effective for only the automatic execution of the fixing device cleaning. Further, in that case, only in the case where the operation mode setting 804 is set at "AUTOMATIC" in S513, processes of S514 in which sheet feeding stage automatic selection setting screen is displayed during the execution of the fixing device feeding and of S515 in which discrimination whether or not the setting of the sheet feeding stage is completed is made are performed (the screen shown in FIG. 11 may also be displayed).

After S515, the CPU 40 provides the UI portion 30 via the UI portion I/F 52 with an instruction to return the sequence to the pop-up screen shown in FIG. 6A, so that the UI portion 30 causes the display portion 30B to display the pop-up screen and then the sequence returns to the process of S501.

In S507, in the case where the button 605 of FIG. 6A is not pressed down, the CPU 40 checks whether or not a condition in which a mode of the image forming apparatus 100 goes to an electric power saving mode (S508). In this embodiment, the CPU 40 causes the mode of the image forming apparatus 100 to go to the electric power saving mode in the case where a predetermined operation is not performed for a predetermined time (for example 5 minutes) measured using a timer managed by an unshown OS. The electric power saving mode is electric power saving mode is a mode (sleeve mode) in which an electric power consumption amount is decreased by the image forming means.

Here, as an example of the predetermined operation, it is possible to cite an operation of the UI portion 30, input of a print job, an occurrence of an error of the image forming apparatus 100 and the like, but the predetermined operation may also be other operations and events. Further, the present invention is applicable without being limited by the condition in which the mode of the image forming apparatus 100 goes to the electric power saving mode. In the case where the CPU 40 discriminated that the condition in which the mode of the image forming apparatus 100 goes to the electric power saving mode is satisfied, the CPU 40 causes the display portion 30B not to display the pop-up screen and causes screen itself of the UI portion 30 to be turned off (S509).

The CPU 40 checks whether or not a condition of restoration from the electric power saving mode is satisfied (S510). The condition of restoration from the electric power saving mode is the case where the predetermined operation is performed in this embodiment.

As an example of the predetermined operation, it is possible to cite an operation of the UI portion 30, input of a print job, an occurrence of an error (for example, opening and closing of a door or cassette) of the image forming apparatus 100 and the like, but the predetermined operation may also be other operations and events. Further, the present invention is applicable without being limited by the condition of restoration from the electric power saving mode.

In S510, in the case where the CPU 40 discriminated that the condition of restoration from the electric power saving mode, the image forming apparatus 100 is restored from the electric power saving mode. Then, the CPU 40 provides the UI portion 30 via the UI portion I/F 52 with an instruction to display the pop-up screen shown in FIG. 6A again, so that the UI portion 30 causes the display portion 30B to display the pop-up screen and the sequence returns to the process of S501.

Here, the reason why the pop-up screen is displayed again when the image forming apparatus 100 is restored from the electric power saving mode is that a display purpose of the pop-up screen such that the user is caused to explicitly select whether the fixing device cleaning is carried out automatically or manually from that time on. Similarly, also in the case where the printing is executed during display of the pop-up screen, it is desirable that the pop-up screen is continuously displayed.

Further, in S508, the CPU 40 similarly causes the sequence to return to the process of S501 also in the case where the CPU 40 discriminated that the condition in which the mode of the image forming apparatus 100 goes to the electric power saving mode.

As described above, in this embodiment, in S403, the pop-up screen is displayed and can go to the setting screen of the operation mode setting 804 or the sheet feeding stage setting 805 through the button 605 of FIG. 6A. Further, even when the operation mode setting 804 or the sheet feeding stage setting 805 is made, the fixing device cleaning is not executed automatically, and the user selects the button 603 or 604 of FIG. 6A, so that the user can select the execution or non-execution of the fixing device cleaning.

However, here, after the setting of S515, in the case where the operation mode setting 804 is "AUTOMATIC", a constitution in which the fixing device cleaning is automatically executed and the pop-up screen is not displayed may also be employed.

Figure 7:
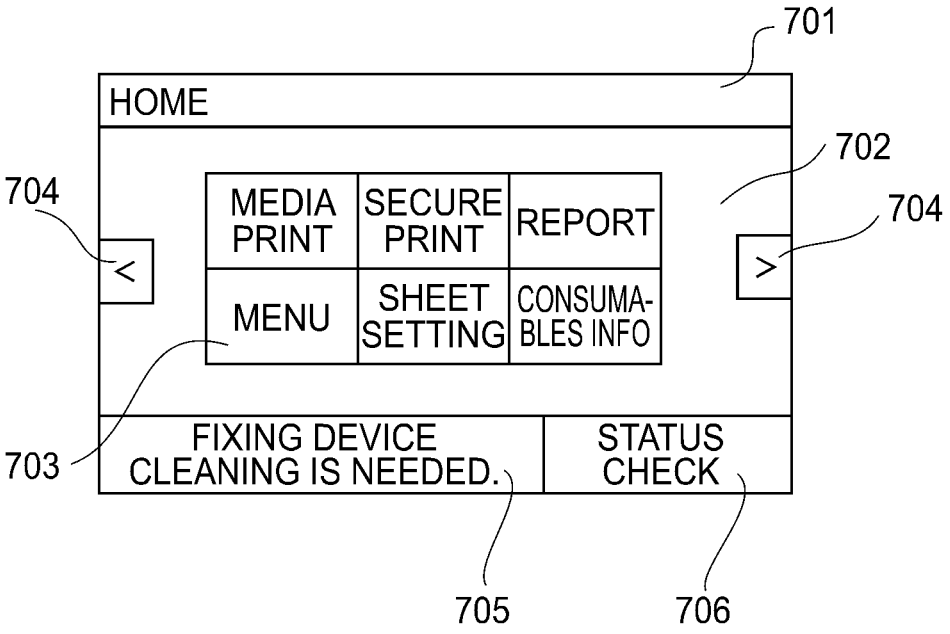
FIG. 7 is a schematic view showing a screen example of a warning display in which execution of the cleaning of the fixing device in the embodiment 1 is recommended.

Further, a screen example (display contents) of warning display recommending execution of the fixing device cleaning displayed in S405 (warning display means) is shown in FIG. 7. Incidentally, FIG. 7 shows a UI screen example of a touch panel type, but a UI screen of a type in which the touch panel is not used is applicable when similar warning display can be made. Further, contents of a message of the warning display are also not limited to those shown in this embodiment.

In the display screen of FIG. 7, a screen title bar 701 displays a screen name. In a function button display region 702, buttons having various functions are displayed, and the display screen is capable of going to a detailed screen of the function of the select function button. In this embodiment, as the functions, six buttons, such as a menu button 703, each having the function are displayed in one screen.

The menu button 703 is capable of displaying and setting a menu for making various settings for operating the image forming apparatus 100 when being selected. Setting menus of the operation mode setting 804 and the sheet feeding stage setting 805 also exist in this menu button 703, and are capable of changing the setting. Further, the menu button 703 also includes a menu for providing the image forming apparatus 100 with an instruction to execute the operation and also includes a menu for manually executing the fixing device cleaning.

Screen switching buttons 704 are capable of switching the display screen to display screens on which other function buttons are displayed by being selected. A status bar 705 (warning display means) displays an occurrence status of a state, an error, warning and the like of the image forming apparatus 100. When the recommended cleaning execution timing is detected, warning prompting the user to carry out the fixing device cleaning is displayed on this status display bar 705.

FIG. 7 is an example in which a home screen (screen which is first displayed and which is a starting point of screen transfer (switching)) of the display portion 30B of the UI portion 30, and thus a frequency of visual recognition of the warning by the user can be increased. Further, the warning may also be displayed even on a screen other than the home screen.

A status check button 706 capable of displaying details of the state of the image forming apparatus 100 by being selected. As contents to be displayed by selecting the status check button 706, it is possible to cite, for example, details of error information, a print job execution status, software version information of the image forming apparatus 100, an IP address of the image forming apparatus 100 and the like, but other contents may also be displayed.

Here, when the selection is made so as to display the details of error information, necessity of the fixing device cleaning is also displayed. Further, when the selection is made so as to display details of the necessity of the fixing device cleaning, a constitution in which the pop-up screen shown in FIG. 6A is displayed again may also be employed.

As a result, there is no need that the user consciously seeks the menus, from the contents of the menu button 703, for carrying out the operation mode setting 804 and the manual execution of the fixing device cleaning, so that user's time and trouble can be saved. Further, it becomes possible to increase an opportunity to change the operation made setting 804 to "AUTOMATIC" and to easily execute manual fixing device cleaning.

As described above, at the recommended cleaning execution timing of the fixing device cleaning, the user can be caused to explicitly select, through the pop-up screen, whether the fixing device cleaning from that time on is carried out automatically or manually. The user is capable of executing the fixing device cleaning at appropriate timing by himself (herself) based on the display indicating the necessity of the fixing device cleaning.

Further, by making the display prompting the user to make automatic execution setting, there is no need that the user who desires the automatic execution of the fixing device cleaning executes the fixing device cleaning by himself (herself), so that it is possible to not only improve usability but also reduce a degree of an image defect due to contamination of the fixing device.

Further, by limiting the display of the pop-up screen to the initial (first) time, inconveniences such that the user is forced to select the setting many times can be reduced. However, although convenience of the user is somewhat reduced, in the case where the operation mode setting 804 is not "AUTOMATIC", every time when the recommended cleaning execution timing is detected, display of the pop-up screen by the display portion 30B of the UI portion 30 may also be produced.

Embodiment 2

In Embodiment 1, in the case where the fixing device 14 is of the heating roller type and employs an internal heating constitution, description of the UI screens displayed for the user and of the flowchart at the recommended cleaning execution timing of the fixing device cleaning was made. In this embodiment (embodiment 2), a difference from embodiment 1 will be principally described in the case where the fixing device 14 is of the heating roller type and employs an external heating constitution.

(1) External Heating Fixing Device

Figure 12:
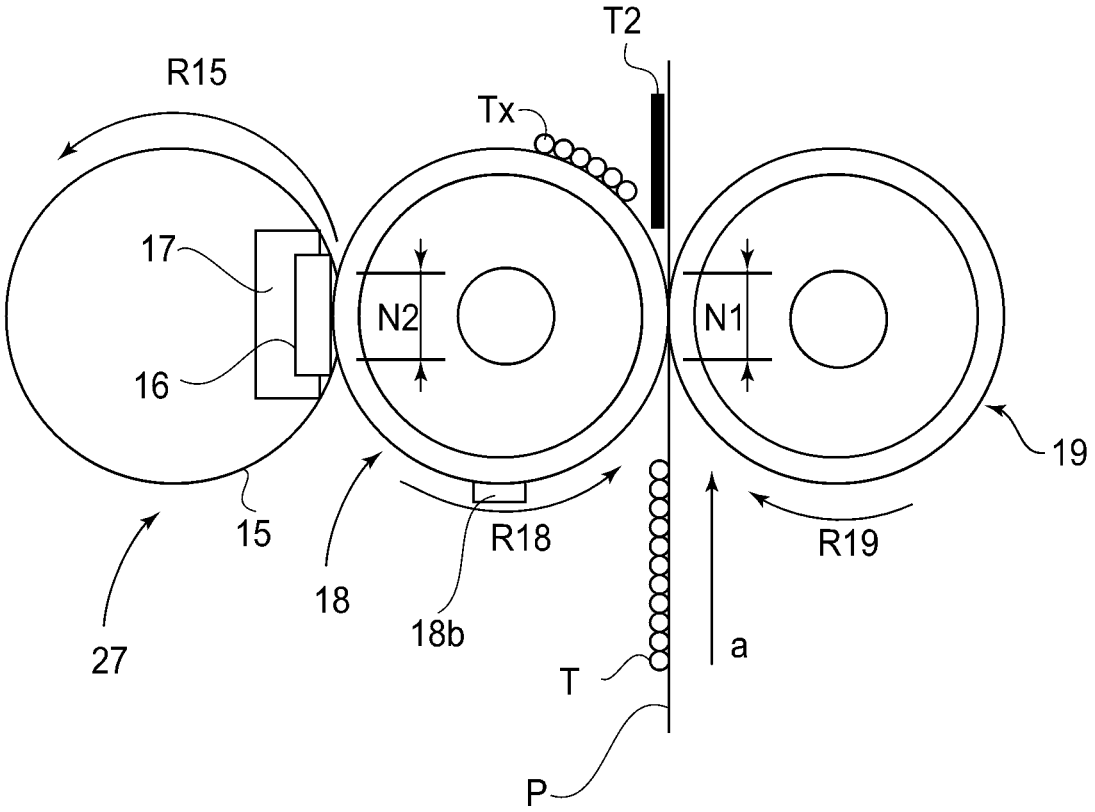
FIG. 12 is a sectional view of a principal part of a fixing device in an embodiment 2.

FIG. 12 is a schematic view of the fixing device (external heating fixing device) 14 employing the external heating constitution used in this embodiment. By employing the external heating fixing constitution, there are advantages of shortening of rise time, reduction in electric power consumption, and ensuring of productivity on small-size paper or the like, such as a B5 size or an A5 size.

In this fixing device 14 of FIG. 12, in comparison with the fixing device 14 of FIG. 3 in Embodiment 1, heating of the fixing roller 18 as the rotatable heating member is made from a front surface side of the fixing roller 18 by an external heating unit 27. A heater for heating the fixing roller 18 from an inside of the fixing roller 18 is not provided in principle, but the heater may also be provided in an auxiliary form. The fixing nip N1 is formed by the fixing roller 18 and the pressing roller 19 as the rotatable pressing member similarly as in the case of the fixing device 14 of embodiment 1. The heater for heating the pressing roller 19 from an inside of the pressing roller 19 may also be provided similarly as in the case of the fixing device 14 in embodiment 1.

The external heating unit 27 is provided in contact with the fixing roller 18 on a side opposite from the pressing roller 19 with respect to the fixing roller 18. The external heating unit 27 includes a rotatable endless (cylindrical) heating film (heating belt) 15, a heater 16 and a heater holder 17. Each of these members 15 to 17 is a long member extending along a longitudinal direction of the fixing roller 18.

As the heater 16, an elongated thin ceramic heater as a low-thermal capacity linear heat generating member having an abrupt rising temperature characteristic by energization. The heater 16 is held by the heater holder 17 using a heat-resistant resin material for preventing positional deviation and breakage of the heater 16. The heating film 15 is a flexible heat conductive member which has a low thickness and low thermal capacity and which has a single-layer structure or a combined layer structure using a heat-resistant resin material or a metal material, and is loosely fitted abound the heater holder 17 supporting the heater 16.

The external heating unit 27 is disposed substantially in parallel to the fixing roller 18 so that the heater 16 side thereof opposes the fixing roller 18. Further, the heater holder 17 is pressed toward the fixing roller 18 by a pressing mechanism (not shown) so that the heater 16 brings the heating film 15 in contact with an outer surface of the fixing roller 18 with a predetermined pressing force (pressure). As a result, between the heating film 15 and the fixing roller 18, a contact external heating portion (external heating nip) N2 with a predetermined width with respect to a rotational direction of the fixing roller 18 is formed.

The heating film 15 is rotated in an arrow R15 direction by rotationally driving the fixing roller 18. That is, a rotational torque is generated in the heating film 15 by a frictional force between the surface of the fixing roller 18 and the surface of the heating film 15 in the contact external heating portion N2. As a result, the heating film 15 is rotated in the arrow R15 direction by rotation of the fixing roller 18 while sliding on the surface of the heater 16.

Then, the heater 16 generates heat by being supplied with electric power, and the heat is conducted to the outer surface of the rotationally driven fixing roller 18 through the heating film 15 in the contact external heating portion N2. That is, an outer peripheral surface of the fixing roller 18 is heated (externally heated) by the external heating unit 27 in the contact external heating portion N2.

A surface temperature of the fixing roller 18 is detected by a temperature detecting element 18*b*. On the basis of detection temperature information inputted from the temperature detecting element 18*b*, the printer controller 32 controls electric power supplied from the external heating unit 27 to the heater 16. That is, the printer controller 32 controls the electric power supplied from an energization portion (not shown) to the heater 16 so that the surface temperature of the fixing roller 18 is increased and maintained at a predetermined temperature.

Further, in a state in which the surface temperature of the fixing roller 18 is increased up to the predetermined temperature and is temperature-controlled at the predetermined temperature, the sheet P on which the unfixed toner images T are carried is inserted into the fixing nip N1, and thus is nipped and fed. An unfixed toner image carrying surface of the sheet P opposes the fixing roller 18. Then, the unfixed toner images T are fixed as fixed images on the sheet P by heat of the fixing roller 18 and nip pressure in the fixing nip N1. That is, heat of the surface of the fixing roller 18 is conducted to the unfixed toner images and the sheet P, so that the toner images T are fixed on the surface of the sheet P.

(2) Accumulation of Contamination of Fixing Device with External Heating Fixing Constitution As described above, in the case of the fixing device 14 (FIG. 3) in which the heating roller type and the internal heating constitution are employed, contamination toner Tx gradually accumulates on the surface of the fixing roller 18 with printing.

On the other hand, in the case of the fixing device 14 (FIG. 12) in this embodiment in which the heating roller type and the external heating constitution are employed, the heating film 14 in the external heating unit 27 peculiar to this embodiment is thin in thickness and therefore is very high in heat dissipation property, so that a heat accumulation as in the fixing roller 18 does not exist. For that reason, the temperature is liable to lower when compared with the fixing roller 18.

The contaminant toner Tx deposited on the fixing roller 18 has a tendency to move to a low surface temperature side, and therefore, moves to the heating film 15 low in temperature. That is, in the case of the fixing device with the external heating constitution, with printing, the contamination toner Tx gradually accumulates on the heating film 15 of the external heating unit 27.

For this reason, even when the fixing device cleaning is carried out immediately after the printing is ended, the contaminant toner Tx deposits on the heating film 15 and does not contact the sheet P for cleaning, so that there is not much cleaning effect.

On the other hand, when the printing is started from a state in which the fixing device 14 is sufficiently cooled and then the fixing device 14 is heated, the surface temperature of the heating film 15 reaches a target fixing temperature. On the other hand, the surface temperature of the fixing roller 18 is taken by a heat insulating layer, and therefore, there is a period of a state in which the temperature increases only up to a temperature lower than the temperature of the heating film 15.

For that reason, in this period of the state, the contaminant toner Tx accumulated on the heating film 15 moves toward the fixing roller 18 lower in temperature. When the sheet P reaches the fixing device in this state, the contaminant toner Tx is transferred onto the sheet P, so that a print result is contaminated. However, conversely, when the fixing device cleaning can be carried out at this timing, it can be said that the cleaning effect is greatest.

From the above reasons, in the case where the fixing device 14 with the external heating constitution, a "state in which the contaminant accumulates and the fixing device is sufficiently cooled" is optimum recommended cleaning execution timing.

Figure 13:
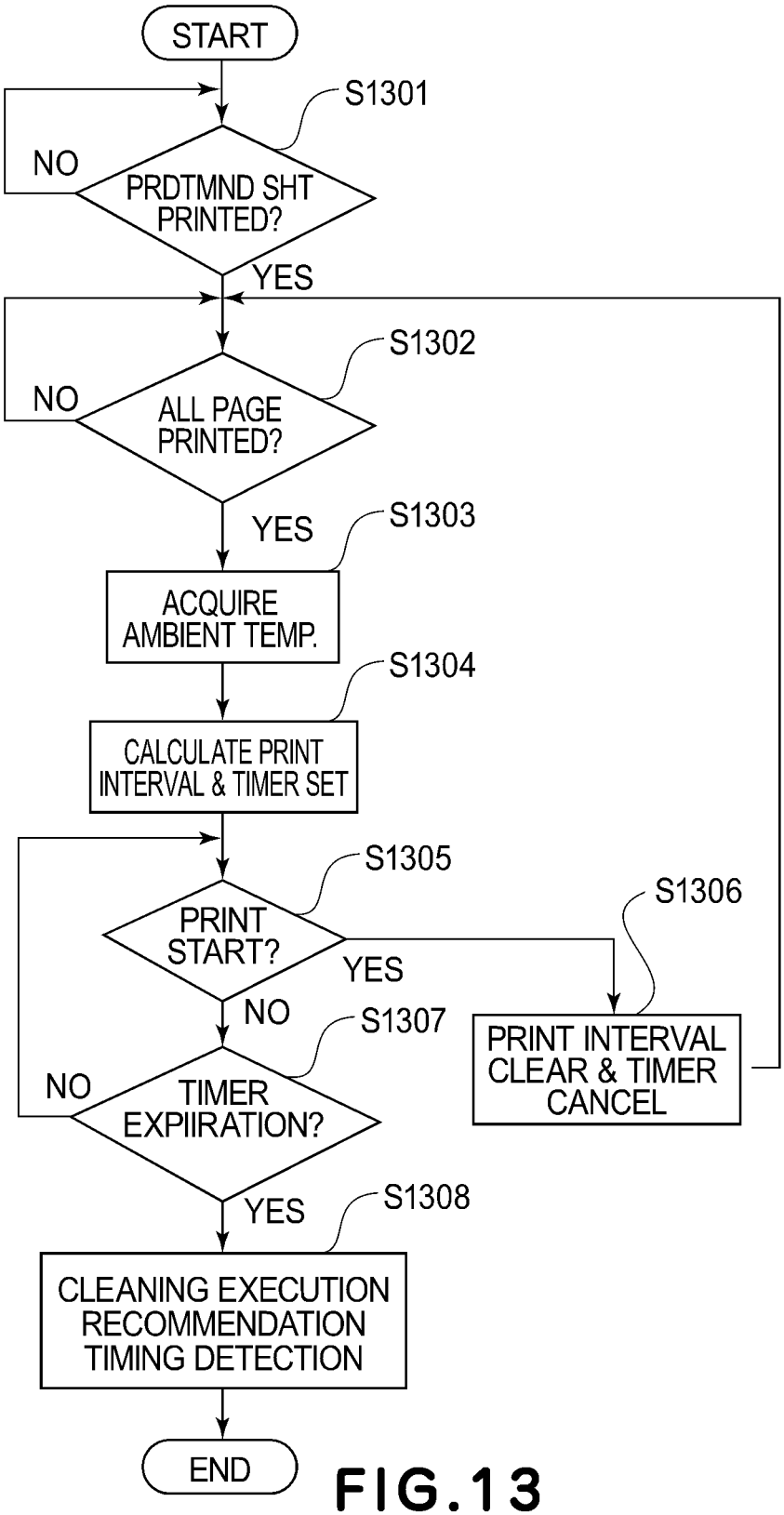
FIG. 13 is a flowchart showing a process for detecting execution recommendation timing of cleaning in the embodiment 2.

Between this embodiment (embodiment 2) and embodiment 1, a detecting method of the recommended cleaning execution timing in S401 of the flowchart of FIG. 1 is different. The detecting method of the recommended cleaning execution timing in Embodiment 2 will be described with reference to FIG. 13.

Here, in this embodiment, characteristic information and setting value examples which are stored in the RAM 42 or the NVMEM 43 are shown in FIG. 14. In FIGS. 14, 1401 to 1405 are the same as 801 to 805 of FIG. 8, and therefore will be omitted from description. Description of respective items 1406 to 1408 will be specifically described later in combination with processes relating to the respective items.

The print controller 53 checks whether or not a cumulative value 1402 of the number of print pages including the halftone region is a predetermined number of sheets or more (S1301). Here, in this embodiment, similarly as in embodiment 1, description will be made assuming that the number of print pages including the halftone region is counted and the cumulative value is held, but the number of pages subjected to printing, or the like number is simply counted and may also be used as the cumulative value. The cumulative value may desirably be determined correspondingly to a contaminant accumulation condition depending on characteristics of the image forming apparatus 100 and the fixing device 14.

In S1301, in the case where discrimination of "NO" is made, counting is continued until the cumulative value 1402 of the number of print pages including the halftone region is the predetermined number of sheets or more.

In S1301, in the case where discrimination of "YES" is made, the print controller 53 checks whether or not all page printing is completed (S1302). In S1302, in the case where discrimination of "NO" is made, the print controller 53 waits for completion of the all page printing. In S1302, in the case where discrimination of "YES" is made, the print controller 53 acquires ambient temperature information from the printer controller 32 via a printer I/F 50 (S1303).

Here, the ambient temperature information 1406 is ambient temperature information acquired from an ambient temperature and humidity sensor 25 (FIG. 2) by the printer controller 32. Incidentally, in this embodiment, an example in which only temperature information is used will be described, but humidity information may also be used in combination with the temperature information. The print controller 53 calculates a print interval (time) 1407 on the basis of the acquired ambient temperature information 1406, and sets the print interval 1407 in a timer managed by an unshown OS (S1304). The print interval 1407 means a time from the completion of the all page printing until the fixing device is sufficiently cooled.

Figure 15:
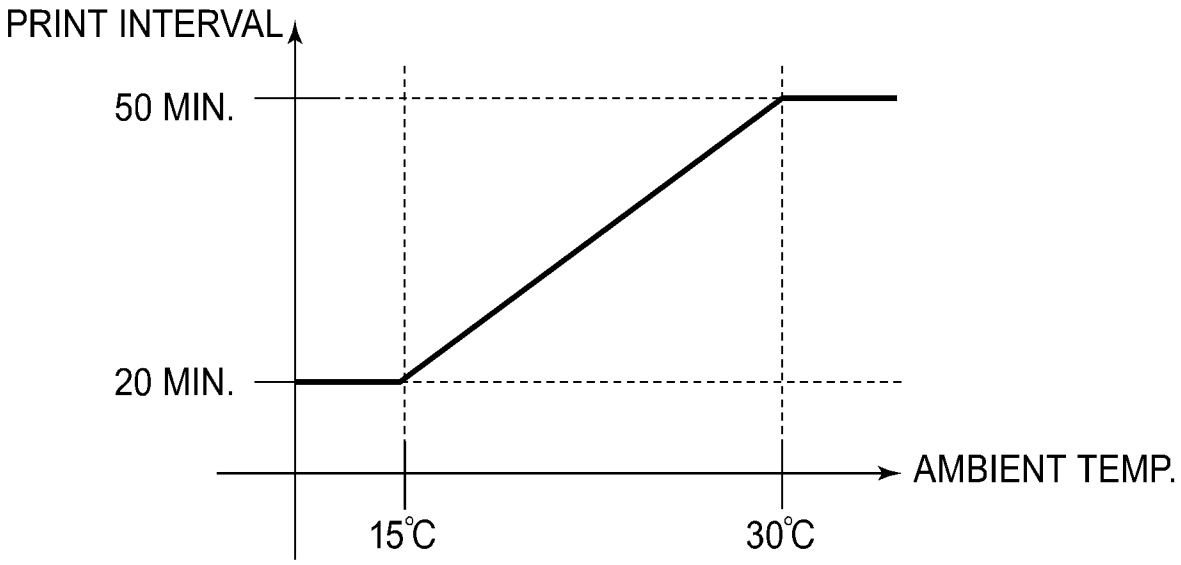
FIG. 15 is a schematic view showing an example of a calculating method of a print interval (time) from ambient temperature information in the embodiment 2.

The print interval 1407 is different depending on the temperature in the image forming apparatus 100 at the time of the completion of the all page printing, and therefore is calculated from the ambient temperature information 1406. An example of a calculating method of the print interval 1407 from the ambient temperature information 1406 is shown in FIG. 15. For example, in the case where the ambient temperature information 1406 is 20° C., the print interval 1407 is 30 minutes.

The print controller 53 monitors whether or not the printing is started until the timer set in S1304 expires (S1305, S1307). In the case where the printing started until the timer expires, the print controller 53 clears the print interval 1407 and also cancels the timer set in S1304 (S1306). When the printing is carried out, the sequence returns to the process of S1302 again.

In the case where in S1307, the unshown OS notifies the print controller 53 of expiration of the timer without starting the printing, the print controller 53 detects that the recommended cleaning execution timing of the fixing device arrives (S1308).

Subsequent processes are similar to those after discrimination of "YES" in S401 of FIG. 1 in the embodiment 1, and therefore will be omitted from description.

Incidentally, in S1307, there is a possibility that the main switch off and the restart of the image forming apparatus 100 are carried out in a period in which the print controller 53 waits for the timer expiration. In order to prepare for such a case, when the print interval 1407 is calculated in S1304, in addition thereto, recommended cleaning execution date and time information (S1408) is also calculated, and then may also be stored in the NVMEM 43.

Further, the recommended cleaning execution date and time information (1408) is stored in the RAM 42, and before the main switch off and the restart of the image forming apparatus 100 are carried out, the CPU 40 notifies the print controller 53 of execution of the main switch off and the restart of the image forming apparatus 100 and then the recommended cleaning execution date and time information (1408) may also be stored in the NVMEM 43. As a result, at the time of the main switch on, a current time of day is compared with the recommended cleaning execution date and time information (1408) stored in the NVMEM 43, whereby it can be known that whether or not there is a need to immediately execute the fixing device cleaning at the time of the main switch on.

In the case where the current time at the time of the main switch on passes the recommended cleaning execution date and time information (1408), the cleaning is executed immediately at the time of the main switch on. In the case where a time between off and on of the main switch, such as during the restart of the image forming apparatus 100 does not much elapse, a difference in time between the recommended cleaning execution date and time information (1408) and the current time is set to the timer, so that it is possible to detect appropriate recommended cleaning execution timing.

As described above, the present invention is also applicable to the case of the image forming apparatus 100 employing the fixing device having the external heating constitution, so that an effect similar to the effect described in the embodiment 1 can be achieved.

Constitutions of the image forming apparatuses 100 and control devices of the above-described embodiments 1 and 2 are summarized as follows.

(A) Image Forming Apparatus 100

The image forming apparatus 100 includes the image forming portion 100B for forming the toner image on the recording material P, and the rotatable heating member 18 and the rotatable pressing member 19 which are used for fixing the toner image on the recording material P by nipping and feeding the recording material P, on which the toner image is formed by the image forming portion 100B, in the nip N1. The image forming apparatus 100 further includes the executing means 53 for executing an operation in a cleaning mode in which the recording material is introduced in the nip N1 and the surface of the rotatable heating member 18 with the sheet, and the first pressing means 53 and S401 for discriminating timing when the operation in the cleaning mode should be performed.

The image forming apparatus 100 includes cleaning operation setting means 605, 615, 623, 1002, 1003 and S512 for setting whether or not the operation in the cleaning mode is automatically performed in the case where discrimination of the timing when the operation in the cleaning mode should be performed is made in the first discriminating means. The image forming apparatus 100 includes cleaning operation control means 53, S404 and S406 for carrying out control so as to perform the operation in the cleaning mode in accordance with the cleaning operation setting 804 in the cleaning operation setting means.

Further, the image forming apparatus 100 includes display means 30B and S403 for producing display of the necessity of execution of the operation in the cleaning mode and display prompting the user to change the cleaning operation setting 804 to setting for automatically performing the operation in the cleaning mode in the case where discrimination of the timing when the operation in the cleaning mode should be performed is made in the first discriminating means.

(B) Control Device

The control device is provided in the image forming apparatus 100 including the image forming portion 100B for forming the toner image on the recording material P, and the rotatable heating member 18 and the rotatable pressing member 19 which are used for fixing the toner image on the recording material P by nipping and feeding the recording material P, on which the toner image is formed by the image forming portion 100B, in the nip N1.

The control device includes the executing means 53 for executing the operation in the cleaning mode in which the recording material is introduced in the nip N1 and the surface of the rotatable heating member 18 with the sheet, and the first pressing means 53 and S401 for discriminating timing when the operation in the cleaning mode should be performed.

The control device includes the cleaning operation setting means 605, 615, 623, 1002, 1003 and S512 for setting whether or not the operation in the cleaning mode is automatically performed in the case where discrimination of the timing when the operation in the cleaning mode should be performed is made in the first discriminating means. The control device includes the cleaning operation control means 53, S404 and S406 for carrying out control so as to perform the operation in the cleaning mode in accordance with the cleaning operation setting 804 in the cleaning operation setting means.

Further, the control device includes display means 30B and S403 for producing display of the necessity of execution of the operation in the cleaning mode and display prompting the user to change the cleaning operation setting 804 to setting for automatically performing the operation in the cleaning mode in the case where discrimination of the timing when the operation in the cleaning mode should be performed is made in the first discriminating means.

Embodiment 3

In the embodiment 2, the case where the fixing device 14 is of the heating roller type and has the external heating constitution was described, but a fixing device in this embodiment has a constitution in which a film (belt) and a heater for heating an image on a recording material through the film while contacting an inner surface of the film, and the present invention is also applicable to this fixing device. In the following, the fixing device in this embodiment will be described.

Figure 16:
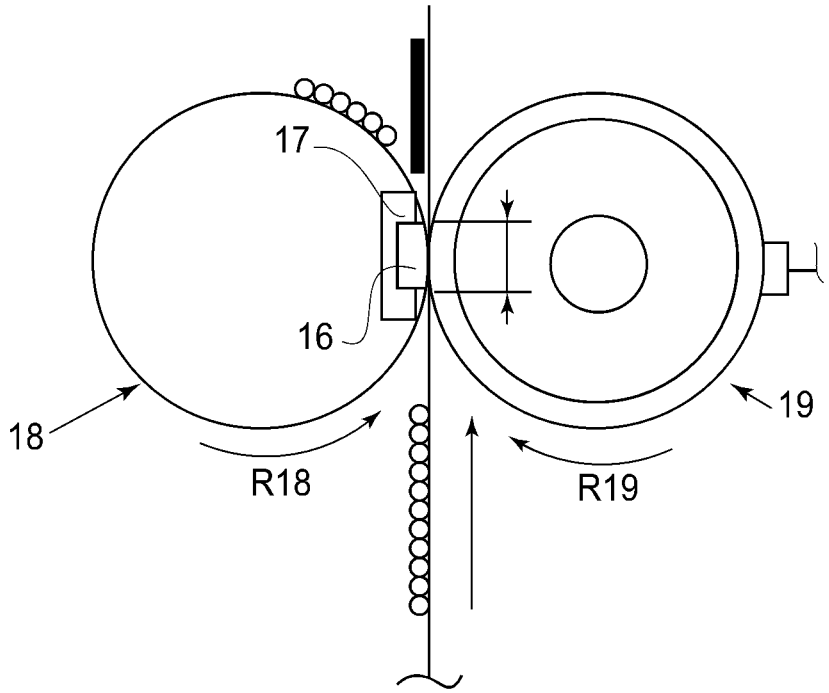
FIG. 16 is a sectional view of a principal part of a fixing device in an embodiment 3.

As shown in FIG. 16, the fixing device in this embodiment is constituted by a film 15 and a pressing roller 19 which form a nip N1 in which the recording material is nipped and fed. The fixing device further includes a heater 16 and a heater holder 17 for pressing the heater 16 and the film 15 against the pressing roller 19. The heater holder 17 holds the heater 16. Further, when the pressing roller 19 rotates in a direction R19, the film 15 rotates in a direction R18. The constitution of the present invention is also effective for such a fixing device.

Other Embodiments (1) In the above-described belts, the display portion (monitor) 30B of the UI portion 30 included in the image forming apparatus 100 is caused to function as the display means for producing various pieces of display such as a cleaning instruction and prompting of switching of the operation in the automatic execution made, but is not limited thereto. It is also possible to employ a constitution in which the display portion (monitor) 300B of the UI portion 300 (FIG. 4) included in the external device 200 such as a PC connected to the controller of the image forming apparatus 100 is caused to function as the display means for producing various pieces of display such a the cleaning instruction and the prompting of switching of the operation in the automatic execution mode.

(2) As the fixing device 14, the fixing device for heating and fixing the unfixed toner image formed on the sheet was described as an example, but is not limited thereto. For example, the fixing device may also be an apparatus (device) for increasing gloss (glossiness) of an image by heating and re-fixing a toner image tentatively fixed on the sheet (also in this case, the apparatus is referred to as the fixing device).

That is, for example, the fixing device may also be an apparatus (device) for fixing a partly fixed toner image on the sheet or an apparatus (device) for heating a fixed image. Accordingly, the fixing device 14 to be mounted in the image forming apparatus 100 is, for example, a surface heating apparatus for adjusting gloss (glossiness) or a surface property of the image.

(3) The rotatable heating member and the rotatable pressing member of the fixing device are not limited to the rollers. A device constitution in which either one or both of these rotatable members are flexible endless belt members may also be employed.

(4) The image forming apparatus 100 described using the printer as an example is not limited to that capable of forming a full-color image, but it may also be a monochromatic (single color) image forming apparatus. The image forming apparatus may be carried out in various uses, such as a copying machine, a facsimile machine, a multifunction machine having the functions of them, or the like, which are prepared by adding necessary device, equipment and casing structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-165051 filed on Sep. 4, 2018, which is hereby incorporated by reference herein in its entirety.

What is claimed is:

1. An image forming apparatus comprising:

an image forming portion configured to form a toner image on a recording material;

a fixing device including a rotatable heating member and a rotatable pressing member which are configured to fix the toner image with heat and pressure by nipping and feeding, in a nip, the recording material on which the toner image is formed by said image forming portion, wherein the image forming apparatus is configured to execute an operation in a cleaning mode for cleaning a surface of said rotatable heating member by introducing, to the nip, a recording material on which a predetermined toner image is formed by said image forming portion or a recording material on which an image is not formed;

a display;

a selector configured to select at least one of (1) an operation in a manual mode for executing the operation in the cleaning mode by manual input, and (2) an operation in an automatic mode for automatically executing the operation in the cleaning mode when a predetermined condition is satisfied; and a controller configured (1) to cause said image forming apparatus to execute the operation in the cleaning mode, when the predetermined condition is satisfied in a state in which the selection for the automatic mode is made, (2) to cause said image forming apparatus to execute a first display mode, when the predetermined condition is satisfied in a state in which the selection for the manual mode is made, wherein the first display mode outputs (a) a display prompting execution of the operation in the cleaning mode and (b) a display prompting selecting for the automatic mode or not, and (3) to cause said image forming apparatus to execute a second display mode, when the predetermined condition is satisfied after executing the first display mode in a state in which the selection for the manual mode is made, wherein the second display mode (a) outputs the display prompting execution of the operation in the cleaning mode and (b) does not output the display prompting selecting for the automatic mode or not.

2. An image forming apparatus according to claim 1, wherein in a case that the selection for automatic mode is made, when the predetermined condition is satisfied, said controller does not output the display prompting execution of the operation in the cleaning mode.

3. An image forming apparatus according to claim 1, wherein the predetermined condition is a number of members, in a predetermined image ratio range, formed on recording materials.

4. An image forming apparatus according to claim 1, wherein in the operation in the cleaning mode, the recording material on which the toner image is formed passes through the nip formed by said rotatable heating member that is heated and said rotatable pressing member.

5. An image forming apparatus according to claim 1, wherein said controller outputs a display prompting replenishment of the recording material in a case that there is no recording material with a size used in the operation in the cleaning mode when the operation in the cleaning mode is executed.

6. An image forming apparatus according to claim 1, wherein the operation in the cleaning mode is executed by manual input when the predetermined condition is not satisfied.

7. An image forming apparatus according to claim 1, wherein said rotatable heating member is a rotatable film and includes a heater contactable to an inner surface of said film.

* * * * *